US007091921B2

(12) United States Patent
Ohno et al.

(10) Patent No.: US 7,091,921 B2
(45) Date of Patent: Aug. 15, 2006

(54) TRAVELING-WAVE COMBINING ARRAY ANTENNA APPARATUS

(75) Inventors: Takeshi Ohno, Moriguchi (JP); Toshihiro Teraoka, Yokohama (JP); Koichi Ogawa, Hirakata (JP); Jiro Hirokawa, Setagaya-ku (JP)

(73) Assignee: Matshushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/504,995

(22) PCT Filed: Feb. 21, 2003

(86) PCT No.: PCT/JP03/01908

§ 371 (c)(1),
(2), (4) Date: Feb. 25, 2005

(87) PCT Pub. No.: WO03/071632

PCT Pub. Date: Aug. 28, 2003

(65) Prior Publication Data

US 2005/0140556 A1 Jun. 30, 2005

(30) Foreign Application Priority Data

Feb. 21, 2002 (JP) ..... 2002-044416

(51) Int. Cl.
*H01Q 13/10* (2006.01)

(52) U.S. Cl. ..... 343/771; 343/853

(58) Field of Classification Search ..... 342/375; 343/771, 853

See application file for complete search history.

(56) References Cited

U.S. PATENT DOCUMENTS 2,482,162 A 9/1949 Feldman
3,267,472 A * 8/1966 Fink ..... 342/368
3,754,272 A 8/1973 Goldstone et al.
4,518,967 A 5/1985 Westerman
4,555,706 A * 11/1985 Haupt ..... 342/81
4,788,552 A * 11/1988 Karlsson ..... 343/771
5,831,583 A * 11/1998 Lagerstedt et al. ..... 343/771
6,107,964 A 8/2000 Hirabe
2005/0030248 A1* 2/2005 Gabriel et al. ..... 343/853
2005/0030249 A1* 2/2005 Gabriel et al. ..... 343/853

* cited by examiner

*Primary Examiner*—Tan Ho

(74) *Attorney, Agent, or Firm*—Wenderoth, Lind & Ponack, L.L.P.

(57) ABSTRACT

A traveling-wave combining array antenna apparatus includes first and second traveling-wave array antennas. The first traveling-wave array antenna has a plurality of antenna elements provided at intervals along a first feeder line, and has a radiating directivity characteristic. The second traveling-wave array antenna has a plurality of antenna elements provided at intervals along a second feeder line, and has a main beam of a half-value width and a radiating directivity characteristic of a side lobe level lower than that of the first traveling-wave array antenna. A transmitting signal is split into two signals, feeding the signals to the first and second traveling-wave array antennas, which are provided so that a variation of main-beam radiating angle of electromagnetic wave of transmitting signal radiated from the first traveling-wave array antenna corresponding to a frequency change, and that of the second traveling-wave array antenna are substantially canceled by each other.

15 Claims, 26 Drawing Sheets

TRAVELING-WAVE COMBINING ARRAY ANTENNA APPARATUS

This application is a 371 of PCT/JP03/01908 filed on Feb. 21, 2003.

TECHNICAL FIELD

The present invention relates to a traveling-wave combining array antenna apparatus, in particular, to a travelling-wave combining array antenna apparatus equipped with two traveling-wave array antennas for use in microwave band, sub-millimeter wave band, millimeter wave band, or the like.

BACKGROUND ART

In radio communication systems for use in microwave band, sub-millimeter wave band, millimeter wave band or the like, there has been widely used a traveling-wave array antenna in which antenna elements are arrayed along a feeder line. In this traveling-wave array antenna, the energy of a transmitting signal travels along the feeder line toward its terminating portion, where a part of the energy is successively radiated so as to be transmitted in a predetermined direction. This traveling-wave array antenna has such a feature that the circuit design of the feeder line is relatively easy.

FIG. 28 is a circuit diagram showing a constitution of a traveling-wave array antenna apparatus 504 according to a prior art.

Referring to FIG. 28, the traveling-wave array antenna apparatus 504 has a plurality of antenna elements 503 arrayed on a feeder line 502 along its longitudinal direction. In this arrangement, an electromagnetic wave inputted via a feeding portion 501 travels along the feeder line 502 toward its terminating portion in a direction of arrow 502*a*, feeding power successively to each of the plurality of antenna elements 503, so that the electromagnetic wave is radiated from each of the antenna elements 503 in a predetermined radiating direction.

The excitation amplitude of each antenna element 503 can be controlled by changing the size and configuration of each antenna element 503 of this traveling-wave array antenna 504, while the excitation phase of each antenna element 503 can be controlled by changing the interval between the adjacent elements of the antenna elements 503. By controlling excitation coefficients each including an excitation amplitude and an excitation phase, the desired radiating directivity characteristic can be obtained.

For example, in base station antennas for use in a subscriber radio system such as a so-called FWA (Fixed Wireless Access) system, an array antenna is often used to form a vertical-plane radiating directivity characteristic, where excitation coefficients of the array antenna are controlled to form a vertical-plane radiating directivity characteristic of a cosecant-squared curve, thus making it possible for respective subscriber radio stations to transmit and receive substantially the same power.

FIG. 29 is a perspective view showing a constitution of a waveguide slot array antenna apparatus 508, which is an example of the traveling-wave array antenna apparatus of FIG. 28.

Referring to FIG. 29, the waveguide slot array antenna apparatus 508 is provided with slot antennas 507 implemented by forming a plurality of rectangular slots, respectively, in a top surface of a rectangular waveguide 506 serving as a feeder line. A rectangular-shaped input opening 505 is formed at a bottom surface so as to close to one terminating portion of the rectangular waveguide 506. A rectangular waveguide 509 of a feeder line is connected to the input opening 505.

In the waveguide slot array antenna apparatus 508 constructed as shown above, a transmitting electromagnetic wave is transmitted from a radio transmitter via the rectangular waveguide 509, and thereafter, is inputted to the rectangular waveguide 506 via the input opening 505. Then, the electromagnetic wave propagates along the longitudinal direction of the rectangular waveguide 506 toward the other terminating portion, and the propagating electromagnetic wave is radiated via the rectangular slots of the slot antennas 507.

In this waveguide slot array antenna apparatus 508, since the use of a rectangular waveguide eliminates the radiation from the feeder line, the loss of the feeder line can be reduced. Further, the excitation amplitude can be controlled by changing the length or width of the rectangular slot of each slot antenna 507, and the excitation phase can be controlled by changing the interval between the adjacent antennas located between the respective rectangular slots, and thus a desired radiating directivity characteristic can be obtained by controlling excitation coefficients each including the excitation amplitude and the excitation phase. Accordingly, it is simple to form an array antenna having the desired radiating directivity characteristic. Therefore, the waveguide slot array antenna apparatus 508 is an array antenna apparatus effective for microwave band, in particular, millimeter wave band.

However, with the construction of the prior art shown in FIGS. 28 and 29, when the frequency of the transmitting electromagnetic wave is changed, the phase delay of the propagating traveling wave between the antenna elements 503 is also changed due to change in guide wavelength within the feeder line 502. Also, in the case of the waveguide slot array antenna apparatus 508, since the traveling wave propagating along the rectangular waveguide 506 passes just under the slot antennas 507, the passed transmitted wave also has a phase delay and is changed in transmitted phase depending on the frequency of the electromagnetic wave. For these reasons, the phase given to the electromagnetic wave radiated from each antenna element 503 or 507 is changed, so that the excitation phase of each antenna element 503 or 507 is changed.

In these array antenna apparatuses 504 and 508, because of a power feeding technique such as the traveling-wave feeding technique as described above, the farther the antenna element is from the power feeding section so as to be close to the input opening 505, the more those phase changes would be accumulated, causing a larger phase change to be given to the radiated electromagnetic wave. Accordingly, occurrence of change in phase difference between the antenna elements 503 or 507 would cause the direction of the main beam of the radiating directivity characteristic of the antenna apparatuses 504 and 508 to change.

For example, in the case where these traveling-wave array antenna apparatuses 504 and 508 are used at a base station of the FWA system, occurrence of change in the main beam direction would cause decrease in the intensity of the received signal at subscriber radio stations present at marginal end portions of the service area as well as falls in the substantial transmitting signal power at those subscriber radio stations.

An object of the present invention is to solve the above-mentioned problems, and to provide a traveling-wave array antenna apparatus capable of suppressing the change in the main beam direction of the radiating directivity characteristic for change in frequency in the transmitting electromagnetic wave.

DISCLOSURE OF INVENTION

According to the present invention, there is provided a traveling-wave combining array antenna apparatus includes first and second traveling-wave array antennas, and a splitter device. The first traveling-wave array antenna has a plurality of first antenna elements provided at predetermined intervals along a first feeder line, and has a predetermined radiating directivity characteristic. The second traveling-wave array antenna has a plurality of second antenna elements provided at predetermined intervals along a second feeder line, and has a main beam of a predetermined half-value width and a radiating directivity characteristic of a side lobe level lower than that of the first traveling-wave array antenna. The splitter device splits an inputted transmitting signal into two transmitting signals, feeding one split transmitting signal to the first traveling-wave array antenna, and feeding another split transmitting signal to the second traveling-wave array antenna.

The first and second traveling-wave array antennas are provided in such a manner that a crossing angle between a traveling direction of an electromagnetic wave of the transmitting signal traveling along the first feeder line and a traveling direction of an electromagnetic wave of the transmitting signal traveling along the second feeder line is larger than 90 degrees and smaller than 270 degrees, so that a variation of main-beam radiating angle of an electromagnetic wave of a transmitting signal radiated from the first traveling-wave array antenna corresponding to a predetermined frequency change, and a variation of main-beam radiating angle of an electromagnetic wave of a transmitting signal radiated from the second traveling-wave array antenna corresponding to the frequency change, are substantially canceled by each other.

In the above-mentioned traveling-wave combining array antenna apparatus, the radiating directivity characteristic of the second traveling-wave array antenna preferably includes (a) a main beam having a half-value width equal to or smaller than 30 degrees, the main beam including a maximum value of an antenna gain, and (b) a side lobe level smaller than −20 dB of the maximum value of the antenna gain.

In the above-mentioned traveling-wave combining array antenna apparatus, the first traveling-wave array antenna and the second traveling-wave array antenna are preferably provided in such a manner that the traveling direction of the electromagnetic wave of the transmitting signal traveling along the first feeder line and the traveling direction of the electromagnetic wave of the transmitting signal traveling along the second feeder line become substantially opposite to each other.

In the above-mentioned traveling-wave combining array antenna apparatus, the first traveling-wave array antenna preferably has a radiating directivity characteristic of a predetermined cosecant-squared curve.

In the above-mentioned traveling-wave combining array antenna apparatus, the splitter device preferably includes a power controller which splits a power of the inputted transmitting signal so that a power of the transmitting signal fed to the first traveling-wave array antenna and a power of the transmitting signal fed to the second traveling-wave array antenna become different from each other.

In the above-mentioned traveling-wave combining array antenna apparatus, the power controller preferably includes an attenuator device which attenuates the transmitting signal fed to the second traveling-wave array antenna by a predetermined attenuation quantity.

In the above-mentioned traveling-wave combining array antenna apparatus, each of the first and second traveling-wave array antennas is preferably one of a waveguide slot array antenna, a dielectric waveguide slot array antenna and a post-wall dielectric waveguide slot array antenna, and the attenuator device is formed by setting a waveguide width of a waveguide of the second traveling-wave array antenna so as to be smaller than a waveguide width of a waveguide of the first traveling-wave array antenna.

In the above-mentioned traveling-wave combining array antenna apparatus, each of the first and second traveling-wave array antennas is preferably one of a dielectric waveguide slot array antenna and post-wall dielectric waveguide slot array antenna, and the attenuator device is formed by setting a dielectric constant of a dielectric waveguide of the second traveling-wave array antenna so as to be larger than a dielectric constant of a dielectric waveguide of the first traveling-wave array antenna.

In the above-mentioned traveling-wave combining array antenna apparatus, each of the first and second traveling-wave array antennas is preferably a post-wall dielectric waveguide slot array antenna, and the attenuator device is formed by setting an inner diameter of each through hole of a post wall of the second traveling-wave array antenna so as to be smaller than an inner diameter of each through hole of a post wall of the first traveling-wave array antenna.

In the above-mentioned traveling-wave combining array antenna apparatus, each of the first and second traveling-wave array antennas is preferably a post-wall dielectric waveguide slot array antenna, and the attenuator device is formed by setting an interval of through holes of the post wall of the second traveling-wave array antenna so as to be larger than an interval of through holes of the first traveling-wave array antenna.

In the above-mentioned traveling-wave combining array antenna apparatus, each of the first and second traveling-wave array antennas is preferably one of a waveguide slot array antenna, a dielectric waveguide slot array antenna and a post-wall dielectric waveguide slot array antenna, and the splitter device and the first and second traveling-wave array antennas are formed within an identical waveguide.

In the above-mentioned traveling-wave combining array antenna apparatus, each of the first and second traveling-wave array antennas is preferably one of a waveguide slot array antenna, a dielectric waveguide slot array antenna and a post-wall dielectric waveguide slot array antenna, and attenuator device includes at least one conductor pin formed so as to close to an input opening of a waveguide of the second traveling-wave array antenna.

In the above-mentioned traveling-wave combining array antenna apparatus, each of the first and second traveling-wave array antennas is preferably one of a waveguide slot array antenna, a dielectric waveguide slot array antenna and a post-wall dielectric waveguide slot array antenna, and the attenuator device includes a waveguide wall formed so as to be close to an input opening of a waveguide of the second traveling-wave array antenna.

The above-mentioned traveling-wave combining array antenna apparatus preferably further includes a phase-delay quantity setting device which sets a quantity of phase delay of the second traveling-wave array antenna so as to be larger than a quantity of phase delay of the first traveling-wave array antenna.

In the above-mentioned traveling-wave combining array antenna apparatus, the phase-delay quantity setting device is preferably formed by setting an interval of the second antenna elements of the second traveling-wave array antenna so as to be larger than an interval of the first antenna elements of the first traveling-wave array antenna.

BEST MODE FOR CARRYING OUT THE INVENTION

Hereinbelow, preferred embodiments according to the present invention are described with reference to the accompanying drawings.

FIRST PREFERRED EMBODIMENT

Figure 1:
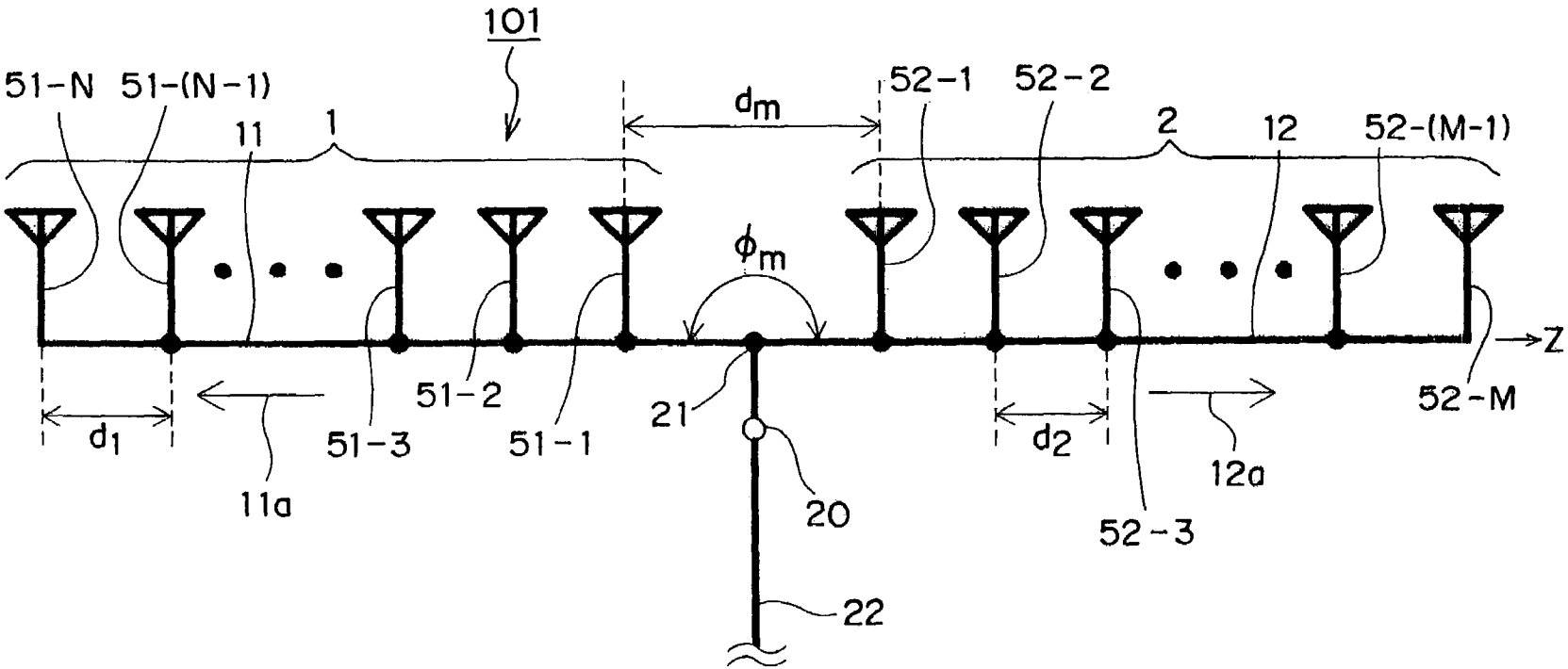
FIG. 1 is a circuit diagram showing a constitution of a traveling-wave combining array antenna apparatus 101 of a first preferred embodiment according to the present invention.

FIG. 1 is a circuit diagram showing a constitution of a traveling-wave combining array antenna apparatus 101 of a first preferred embodiment according to the present invention. As shown in FIG. 1, the traveling-wave combining array antenna apparatus 101 according to the first preferred embodiment includes the following:

(a) a traveling-wave array antenna 1, which is provided with a plurality of N antenna elements 51-1 to 51-N arrayed side by side at a predetermined interval $d_1$ along the longitudinal direction of a feeder line 11, i.e. in a −Z-axis direction, and which has a vertical-plane radiating directivity characteristic of a narrow beam and a low side lobe; and (b) a traveling-wave array antenna 2, which is provided with a plurality of M antenna elements 52-1 to 52-M arrayed side by side at a predetermined interval $d_2$ along the longitudinal direction of a feeder line 12, i.e. in a Z-axis direction opposite to the −Z-axis direction, and which has a predetermined vertical-plane radiating directivity characteristic of, for example, a cosecant-squared curve.

In this arrangement, these two traveling-wave array antennas 1 and 2 are characterized in that these traveling-wave array antennas 1 and 2 are provided in juxtaposition with a predetermined interval $d_m$ from each other, and that longitudinal directions of their respective feeder lines 11 and 12 cross each other at a crossing angle $\phi_m$, where preferably $\phi_m$=180 degrees, and electromagnetic-wave traveling directions within the feeder lines 11 and 12 are opposite to each other. In addition, in the first preferred embodiment, it is set that $\phi_m$=180 degrees and the longitudinal direction of the center axis is located on the Z-axis in each of the feeder lines 11 and 12.

Referring to FIG. 1, a transmitting signal outputted from a radio transmitter is inputted to a power splitter 21 via a feeder line 22 and a feeding portion 20, and the power splitter 21 equally divides and splits the inputted transmitting signal into two signals, outputting one transmitting signal to the feeder line 11 of the traveling-wave array antenna 1 while outputting the other transmitting signal to the feeder line 12 of the traveling-wave array antenna 2. An electromagnetic wave of the input signal inputted to the feeder line 11 propagates in a direction of arrow 11*a* within the feeder line 11, and is outputted while feeding the power in branching the same successively to the antenna elements 51-1 to 51-N arrayed side by side in the feeder line 11, and thus the electromagnetic wave thereof is radiated with a predetermined vertical-plane radiating directivity characteristic of a narrow beam and a low side lobe. On the other hand, the electromagnetic wave of the transmitting signal inputted to the feeder line 12 propagates in a direction of arrow 12*a* (opposite to the arrow 11*a*) within the feeder line 12, and is outputted while feeding the power in branching the same successively to the antenna elements 52-1 to 52-M arrayed side by side in the feeder line 12, and thus the electromagnetic wave thereof is radiated with a predetermined vertical-plane radiating directivity characteristic of, for example, a cosecant-squared curve.

In the traveling-wave combining array antenna apparatus 101 constituted as described above, the traveling-wave array antennas 1 and 2 are both disposed on one Z-axis, and the traveling directions of electromagnetic waves within the feeder lines 11 and 12 are opposite to each other. Therefore, the change in the main-beam directions of the traveling-wave array antennas 1 and 2 upon a change in the frequency of the electromagnetic wave of the transmitting signal act in directions opposite to each other to cancel each other, making it possible suppress the variation $\Delta\theta$ of the main-beam direction for the whole traveling-wave combining array antenna apparatus 101.

Further, by setting the vertical-plane radiating directivity characteristic of one traveling-wave array antenna 1 to the narrow-beam and the low-side-lobe, the vertical-plane radiating directivity characteristic of the whole traveling-wave combining array antenna apparatus 101 can be made close to the vertical-plane radiating directivity characteristic of the other traveling-wave array antenna 2. It is to be noted here that, with respect to the narrow-beam and low-side-lobe vertical-plane radiating directivity characteristic, the angular range of a 3 dB width (half-value width) corresponding to the narrow beam is preferably in a range from 5 to 40 degrees, more preferably from 5 to 30 degrees, and even more preferably from 5 to 40 degrees, while the relative amplitude (with the main beam assumed as 0 dB) corresponding to the low side lobe is preferably −20 dB or lower, more preferably −30 dB or lower.

Now, the traveling-wave array antennas 1 and 2 are designed under the conditions of N=M=16 and the center frequency f0=25.48 GHz, and the variation Δθ of the main beam over a bandwidth Δf=420 MHz from lower-limit frequency f1=25.27 GHz to upper-limit frequency f2=25.69 GHz is calculated with array factors (radiating patterns resulting when the antenna elements have no directivity characteristic, where each antenna element is regarded as a wave source) of the traveling-wave array antennas 1 and 2. It is noted that the actual vertical-plane radiating directivity characteristics of the traveling-wave array antennas 1 and 2 can be calculated by multiplying array factors by element factors, which are the vertical-plane radiating directivity characteristics, of the antenna elements 51-1 to 51-N and 52-1 to 52-M, respectively. In this case, guide wavelengths λg of the feeder lines 11 and 12 are set to λg0=9.64 mm at the center frequency f0, λg1=9.76 mm at the lower-limit frequency f1, and λg2=9.52 mm at the upper-limit frequency f2. This corresponds to a dielectric waveguide in which a rectangular waveguide of 3.2 mm high×7 mm wide is internally filled with a dielectric having a dielectric constant of $\in_r$=2.2.

First of all, a simulation was performed under the conditions that the antenna element interval $d_1$ of the traveling-wave array antenna 1 was set to $d_1$=10.5 mm constant and that electromagnetic waves having excitation amplitudes and excitation phases shown in the following Table 1 were inputted to the respective antenna elements 51-1 to 51-16 of the traveling-wave array antenna 1. The results of the simulation, i.e. radiating patterns (normalized amplitudes) versus vertical-plane angles with frequencies of f0, f1 and f2, are shown in FIGS. 2A, 2B and 2C, respectively.

TABLE 1

| Element No. | Excitation Amplitude (dB) | Excitation Phase (degree) |
|---|---|---|
| 1 | −25.642 | 0.000 |
| 2 | −20.829 | 9.895 |
| 3 | −13.814 | 19.790 |
| 4 | −8.775 | 29.685 |
| 5 | −5.092 | 39.579 |
| 6 | −2.489 | 49.474 |
| 7 | −0.818 | 59.369 |
| 8 | 0.000 | 69.264 |
| 9 | 0.000 | 79.159 |
| 10 | −0.818 | 89.054 |
| 11 | −2.489 | 98.948 |
| 12 | −5.092 | 108.843 |
| 13 | −8.775 | 118.738 |
| 14 | −13.814 | 128.633 |
| 15 | −20.829 | 138.528 |
| 16 | −25.642 | 148.423 |

Figure 2A:
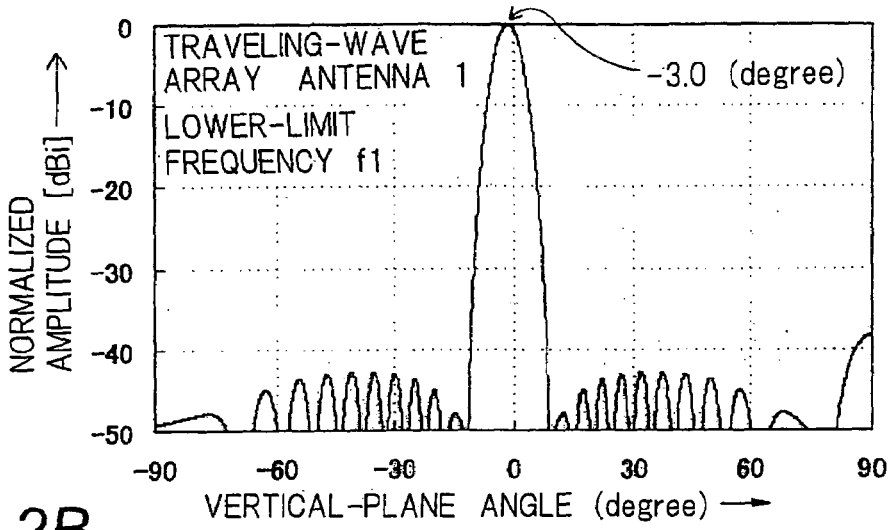
FIG. 2A is a graph showing a radiating pattern (normalized amplitude) versus a vertical-plane angle of a traveling-wave array antenna 1 of FIG. 1 with a lower-limit frequency of f1.
Figure 2B:
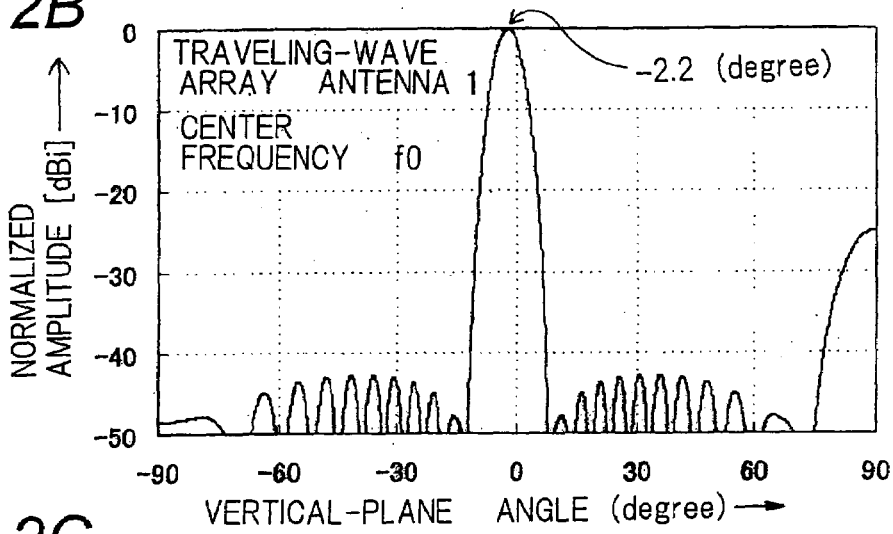
FIG. 2B is a graph showing a radiating pattern (normalized amplitude) versus a vertical-plane angle of the traveling-wave array antenna 1 of FIG. 1 with a center frequency of f0.
Figure 2C:
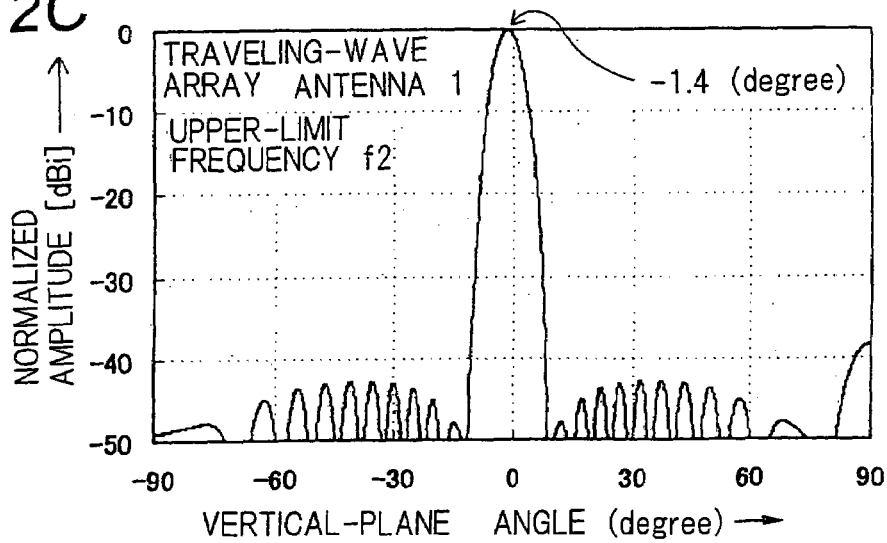
FIG. 2C is a graph showing a radiating pattern (normalized amplitude) versus a vertical-plane angle of the traveling-wave array antenna 1 of FIG. 1 with an upper-limit frequency of f2.

As apparent from FIGS. 2A, 2B and 2C, a vertical-plane radiating directivity characteristic of a narrow beam and a low side lobe can be obtained at the respective frequencies. In FIGS. 2A, 2B, 2C and figures showing array factors hereinbelow, a front-facing direction vertical to the Z-axis of the traveling-wave array antennas 1 and 2 is assumed as a vertical-plane angle of 0 degrees, and angles rotated from the axis of the 0-degree angle toward an axis of the traveling direction of the electromagnetic waves within the feeder lines 11 and 12 are assumed as positive angles. In FIGS. 2A, 2B and 2C, the angle of the main beam at the lower-limit frequency f1 is −3.0 degrees, the angle of the main beam at the center frequency f0 is −2.2 degrees, and the angle of the main beam at the upper-limit frequency f2 is −1.40 degrees. Therefore, the variation of the main-beam direction corresponding to a frequency change Δf=420 MHz results in a variation Δθt=+1.6 degrees.

Next, a simulation was performed under the conditions that the antenna element interval $d_2$ of the traveling-wave array antenna 2 was set to $d_2$=8.43 mm constant and that electromagnetic waves each having an excitation amplitude and an excitation phase shown in the following Table 2 were inputted to the respective antenna elements 52-1 to 52-16 of the traveling-wave array antenna 2. The results of the simulation, i.e. radiating patterns (normalized amplitudes) versus vertical-plane angles at frequencies f0, f1 and f2 are shown in FIGS. 3A, 3B and 3C, respectively.

TABLE 2

| Element No. | Excitation Amplitude (dB) | Excitation Phase (degree) |
|---|---|---|
| 1 | 0.000 | 0.000 |
| 2 | −0.140 | −36.911 |
| 3 | −0.379 | −53.340 |
| 4 | −0.624 | −64.752 |
| 5 | −1.112 | −75.672 |
| 6 | −1.390 | −87.572 |
| 7 | −1.497 | −96.976 |
| 8 | −2.014 | −105.139 |
| 9 | −2.615 | −115.673 |
| 10 | −2.792 | −125.086 |
| 11 | −3.242 | −130.568 |
| 12 | −4.282 | −137.481 |
| 13 | −4.833 | −147.328 |
| 14 | −4.787 | −150.693 |
| 15 | −5.746 | −146.767 |
| 16 | −9.106 | −152.645 |

Figure 3A:
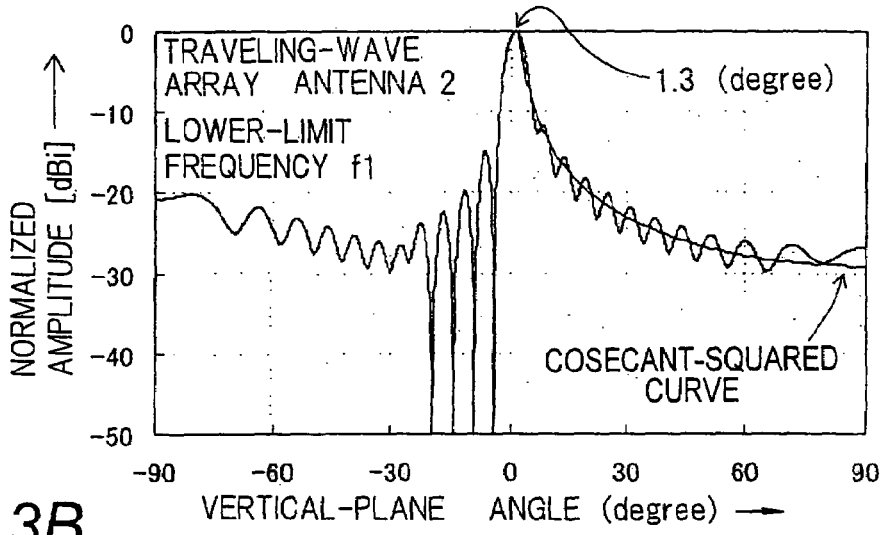
FIG. 3A is a graph showing a radiating pattern (normalized amplitude) versus a vertical-plane angle of a traveling-wave array antenna 2 of FIG. 1 with a lower-limit frequency of f1.
Figure 3B:
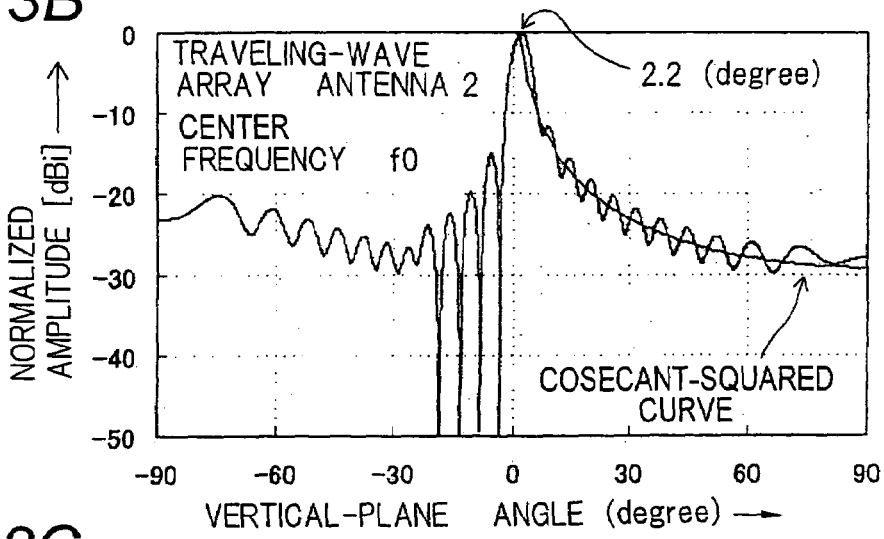
FIG. 3B is a graph showing a radiating pattern (normalized amplitude) versus a vertical-plane angle of the traveling-wave array antenna 2 of FIG. 1 with a center frequency of f0.
Figure 3C:
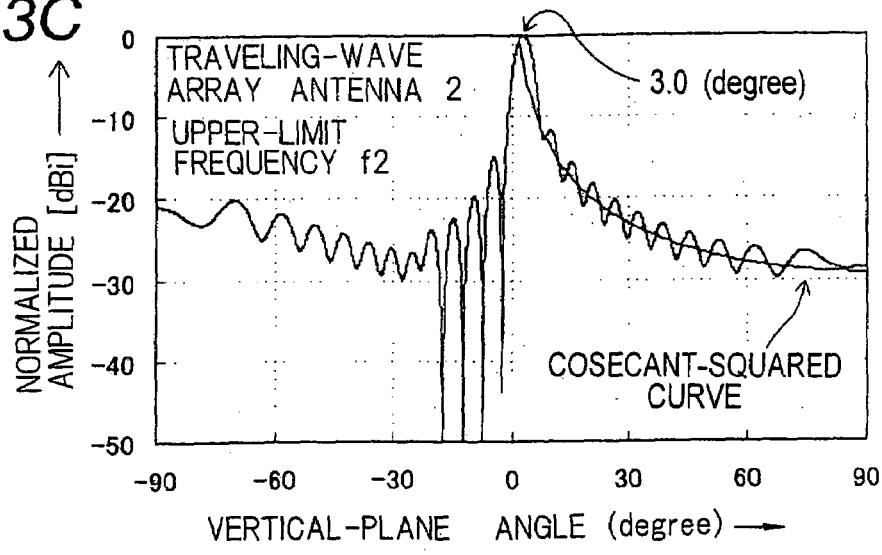
FIG. 3C is a graph showing a radiating pattern (normalized amplitude) versus a vertical-plane angle of the traveling-wave array antenna 2 of FIG. 1 with an upper-limit frequency of f2.

As apparent from FIGS. 3A, 3B and 3C, a vertical-plane radiating directivity characteristic of a cosecant-squared curve can be obtained at the respective frequencies. In FIGS. 3A, 3B and 3C, the angle of the main beam at the lower-limit frequency f1 is +1.3 degrees, the angle of the main beam at the center frequency f0 is +2.2 degrees, and the angle of the main beam at the upper-limit frequency f2 is +3.0 degrees. Therefore, the variation of the main-beam direction corresponding to a frequency change Δf=420 MHz results in a variation Δθt=+1.7 degrees.

The power of the transmitting signal fed to the traveling-wave array antenna 1 out of the two traveling-wave array antennas 1 and 2 is attenuated by, for example, 10 dB, with the use of an attenuator inserted between the power splitter 21 and the feeder line 11, and this leads to the excitation amplitudes of the antenna elements 51-1 to 51-N of the traveling-wave array antenna 1 being lowered by 10 dB. As a result of this, the vertical-plane radiating directivity characteristic of a cosecant-squared curve, which is the vertical-plane radiating directivity characteristic of the traveling-wave array antenna 2, becomes predominant in the array-antenna directivity characteristic of the whole traveling-wave combining array antenna apparatus 101. However, the traveling-wave array antenna 2 becomes predominant also for the variation $\Delta\theta t$ of the main-beam direction corresponding to the frequency change $\Delta f$ of the traveling-wave combining array antenna apparatus 101. For this reason, the antenna element interval $d_1$ of the traveling-wave array antenna 1 is set so as to be larger than the antenna element interval $d_2$ of the traveling-wave array antenna 2, and this leads to it being possible to adjust the cancellation quantity of variations of the main-beam direction between the traveling-wave array antennas 1 and 2. Thus, by these two factors complementing each other, the variation $\Delta\theta$ of the main-beam direction is suppressed while the vertical-plane radiating directivity characteristic of the cosecant-squared curve is maintained.

Figure 4A:
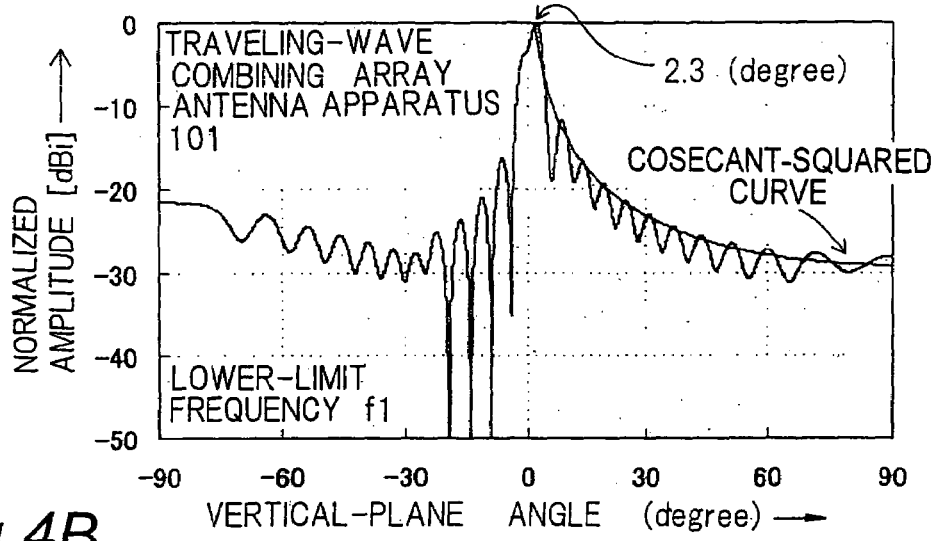
FIG. 4A is a graph showing a radiating pattern (normalized amplitude) versus a vertical-plane angle of the traveling-wave combining array antenna apparatus 101 of FIG. 1 with a lower-limit frequency of f1.
Figure 4B:
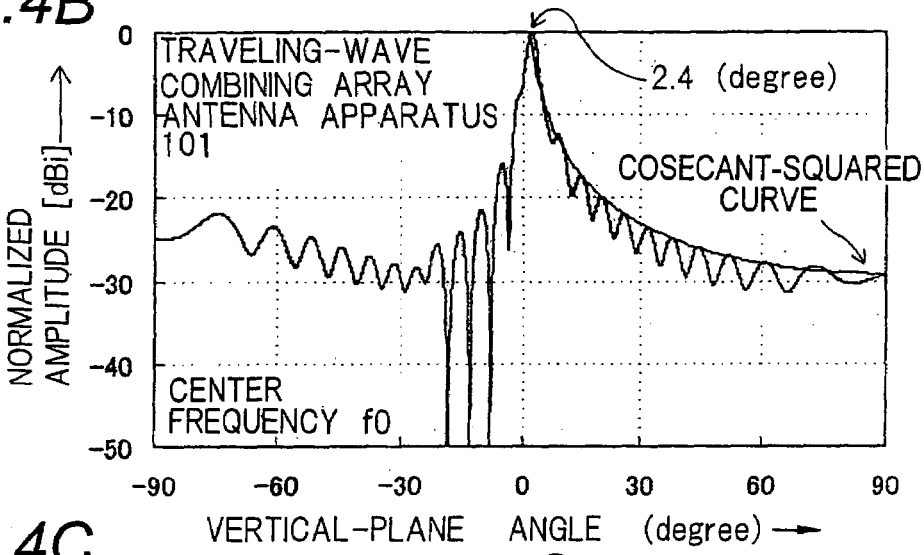
FIG. 4B is a graph showing a radiating pattern (normalized amplitude) versus a vertical-plane angle of the traveling-wave combining array antenna apparatus 101 of FIG. 1 with a center frequency of f0.
Figure 4C:
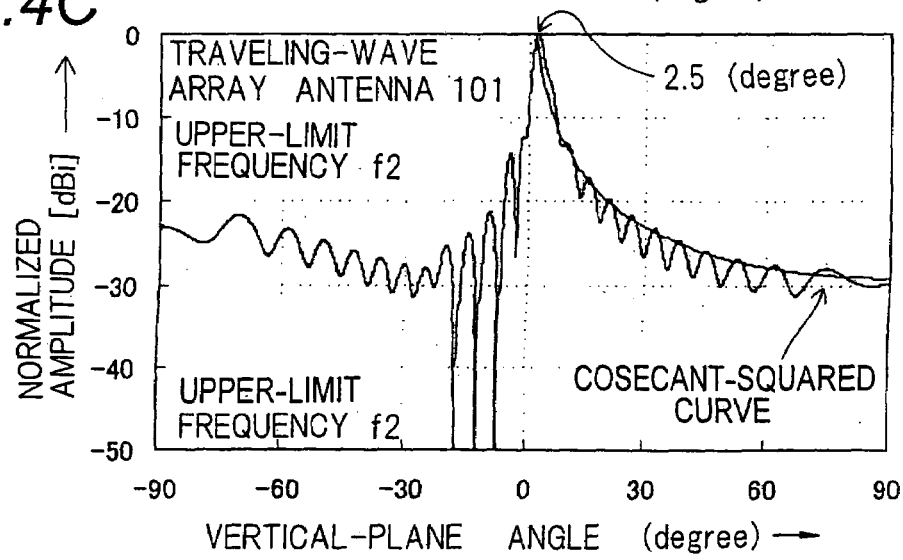
FIG. 4C is a graph showing a radiating pattern (normalized amplitude) versus a vertical-plane angle of the traveling-wave combining array antenna apparatus 101 of FIG. 1 with an upper-limit frequency of f2.

Now, the results of calculating the array factor of the traveling-wave combining array antenna apparatus 101 with an interval $d_m$=8.43 mm between the two traveling-wave array antennas 1 and 2, i.e. the calculation results at the frequencies of f1, f0 and f2, are shown in FIGS. 4A, 4B and 4C, respectively. It is noted that the definition of vertical-plane angle is the same as that of the traveling-wave array antenna 2.

As apparent from FIGS. 4A, 4B and 4C, the angle of the main beam at the lower-limit frequency f1 is +2.3 degrees, the angle of the main beam at the center frequency f0 is +2.4 degrees, and the angle of the main beam at the upper-limit frequency f2 is +2.5 degrees. Therefore, the variation of the main-beam direction corresponding to the frequency change $\Delta f$=420 MHz is a variation $\Delta\theta t$=+0.2 degrees. Thus, even if the frequency of the electromagnetic wave is changed, the variation $\Delta\theta$ of the main-beam direction can be suppressed to $\Delta\theta$=0.2 degrees while the vertical-plane radiating directivity characteristic of the cosecant-squared curve is maintained.

In the above-mentioned simulations, calculation results of the array factor have been shown with importance placed on generality. The variation $\Delta\theta$ of the main-beam direction would change depending on given element factors or excitation coefficients. However, by properly splitting power fed to the two traveling-wave array antennas 1 and 2 and balancing of the interval between the adjacent elements or feeder line guide wavelength, the variation $\Delta\theta$ of the main-beam direction of the traveling-wave combining array antenna apparatus 101 can be suppressed.

Although the simulation results are shown on the assumption of the antenna element numbers N=M=16 in the above-mentioned preferred embodiment, the present invention is not limited to this and the antenna element numbers may be such that N≠M.

In the above-mentioned preferred embodiment, the crossing angle $\phi_m$ of the two traveling-wave array antennas 1 and 2 is set to 180 degrees. However, the present invention is not limited to this, and the crossing angle $\phi_m$ may be also set so as to be within a range of 90 degrees<$\phi_m$<270 degrees, preferably a range of 120 degrees<$\phi_m$<210 degrees, and more preferably a range of 150 degrees<$\phi_m$<240 degrees, so that the variation $\Delta\theta t$ of the main-beam radiating angle of the electromagnetic wave of the transmitting signal radiated from the traveling-wave array antenna 1 corresponding to a predetermined frequency change $\Delta f$, and the variation $\Delta\theta c$ of the main-beam radiating angle of the electromagnetic wave of the transmitting signal radiated from the traveling-wave array antenna 2 corresponding to the frequency change $\Delta f$, are substantially canceled by each other. As a result of this, the angular variation of the main beam due to the frequency change $\Delta f$ can be mutually canceled by the respective vertical-plane radiating directivity characteristics of the two traveling-wave array antennas 1 and 2, and this leads to suppression of the angular variations. In more detail, in the case of setting to the range of 90 degrees<$\phi_m$<270 degrees, the traveling-wave array antenna 1 and the traveling-wave array antenna 2 are provided in juxtaposition in such a way that the traveling direction of the electromagnetic wave of the transmitting signal traveling along the feeder line 11 and the traveling direction of the electromagnetic wave of the transmitting signal traveling along the feeder line 12 do not at least perpendicularly cross each other, and the crossing angle of the traveling directions do not become an acute angle, either. In this case, the components of the radiation power are at least partly canceled by each other. On the other hand, for maximization of the cancellation effect, the crossing angle $\phi_m$ is preferably set to $\phi_m$=180 degrees, in which case the traveling-wave array antenna 1 and the traveling-wave array antenna 2 are provided in juxtaposition so that the traveling direction of the electromagnetic wave (linearly polarized wave) of the transmitting signal traveling along the feeder line 11 and the traveling direction of the electromagnetic wave (linearly polarized wave) of the transmitting signal traveling along the feeder line 12 are substantially opposed to each other.

In the above-mentioned preferred embodiment, the traveling-wave array antenna 1 has the vertical-plane radiating directivity characteristic of the narrow beam and the low side lobe, and it is necessary to only have at least such a vertical-plane radiating directivity characteristic having a main beam of a predetermined half-value width and a side lobe level lower than that of the traveling-wave array antenna 2. More preferably, the radiating directivity characteristic of the traveling-wave array antenna 1 includes the following:

(a) a main beam of a half-value width equal to or smaller than 30 degrees, and the main beam thereof including the maximum value of the antenna gain thereof; and (b) a side lobe level smaller than −20 dB of the maximum value of the antenna gain thereof.

In the above-mentioned preferred embodiment, the power of the transmitting signal fed to the traveling-wave array antenna 1 out of the two traveling-wave array antennas 1 and 2 is attenuated by, for example, 10 dB, with the use of an attenuator inserted between the power splitter 21 and the feeder line 1. However, this quantity of attenuation is preferably set within a range of 8 to 20 dB, and more preferably within a range of 8 to 16 dB.

Although the power of the transmitting signal fed to the traveling-wave array antenna 1 out of the two traveling-wave array antennas 1 and 2 is attenuated by, for example, 10 dB, with the use of an attenuator inserted between the power splitter 21 and the feeder line 11 of the above-mentioned preferred embodiment, it is also possible that the transmitting signal to the traveling-wave array antenna 2 is amplified to increase the power fed thereto. That is, the powers fed to the two traveling-wave array antennas 1 and 2 may be controlled so as to become different from each other. This may be applied to the other preferred embodiments.

SECOND PREFERRED EMBODIMENT

Figure 5:
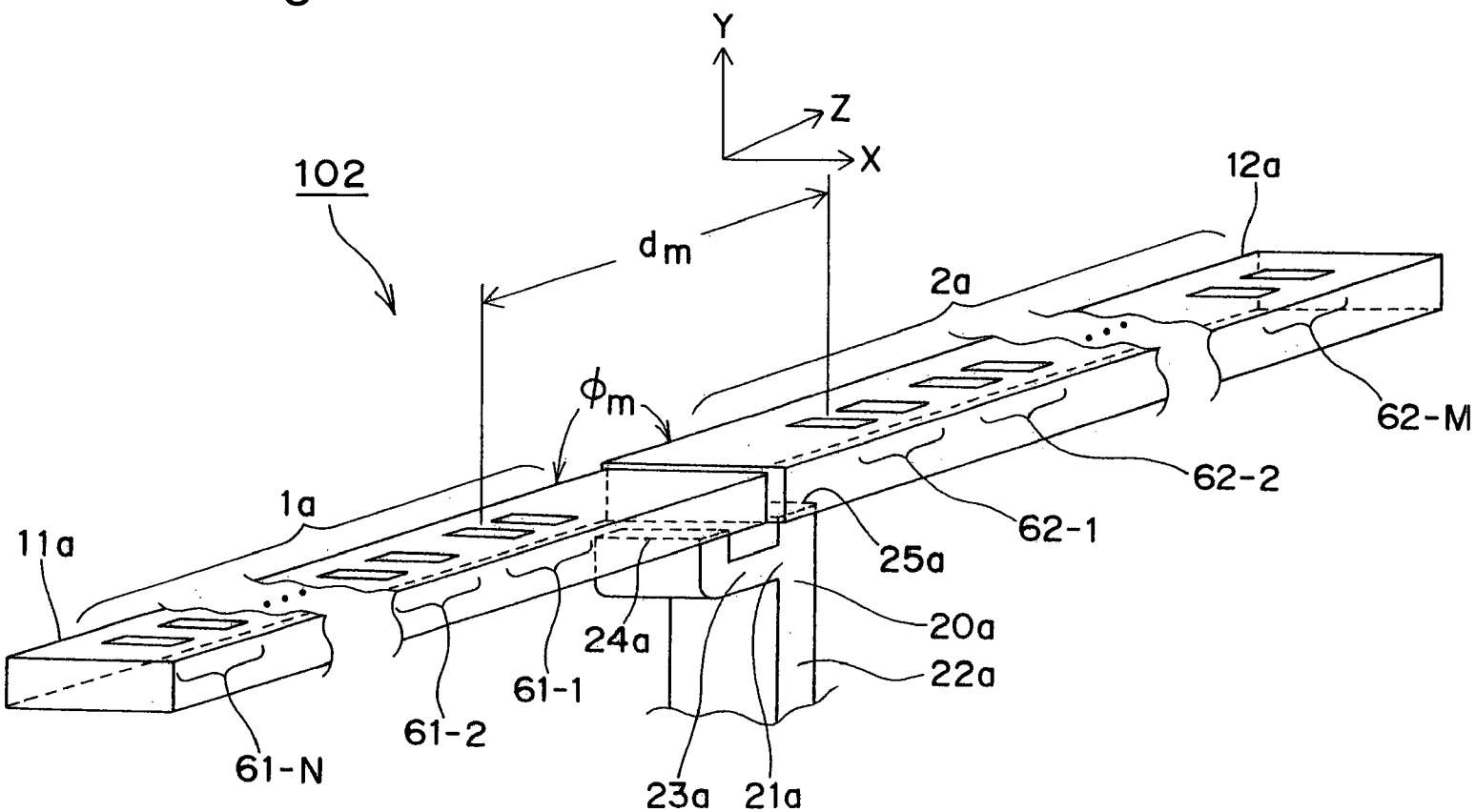
FIG. 5 is a perspective view showing a constitution of a traveling-wave combining array antenna apparatus 102 of a second preferred embodiment according to the present invention.
Figure 6:
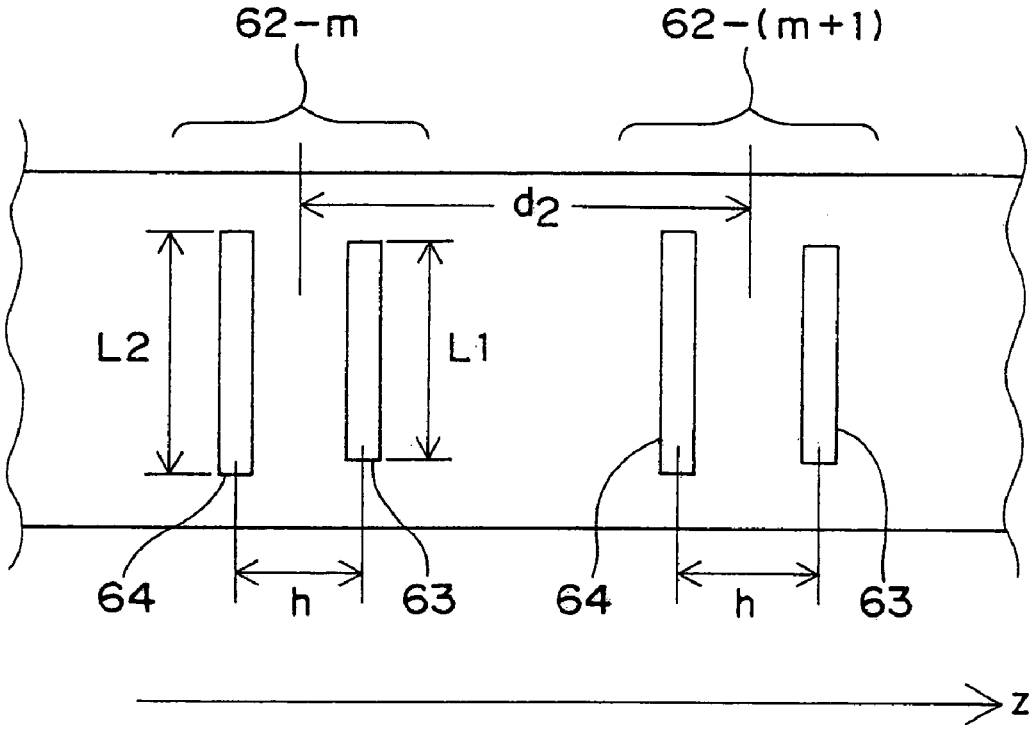
FIG. 6 is a top view showing a constitution in the vicinity of two slot pair antennas 62-m and 62-(m+1) in a traveling-wave array antenna 2*a* of FIG. 5.

FIG. 5 is a perspective view showing a constitution of a traveling-wave combining array antenna apparatus 102 of a second preferred embodiment according to the present invention. FIG. 6 is a top view showing a constitution in the vicinity of two slot pair antennas 62-m and 62-(m+1) in a traveling-wave array antenna 2*a* of FIG. 5.

In the traveling-wave combining array antenna apparatus 102 according to the second preferred embodiment, the feeder lines 11 and 12 in the first preferred embodiment are implemented by rectangular waveguides 11*a* and 12*a*, and the antenna elements 51-1 to 51-N and 52-1 to 52-M are implemented by slot pair antennas, respectively. The traveling-wave combining array antenna apparatus 102 comprises the following:

(a) a traveling-wave array antenna 1*a*, which is provided with a plurality of N slot pair antennas 61-1 to 61-N arrayed side by side at a predetermined interval $d_1$ along the longitudinal direction of a rectangular waveguide 11*a*, i.e., in a −Z-axis direction, and which is a waveguide slot array antenna having a vertical-plane radiating directivity characteristic of a narrow beam and a low side lobe; and (b) a traveling-wave array antenna 2*a*, which is provided with a plurality of M slot pair antennas 62-1 to 62-M arrayed side by side at a predetermined interval $d_2$ along the longitudinal direction of a rectangular waveguide 12*a*, i.e., in a Z-axis direction opposite to the −Z-axis direction, and which is a waveguide slot array antenna having a predetermined vertical-plane radiating directivity characteristic of, for example, a cosecant-squared curve.

In this case, these two traveling-wave array antennas 1*a* and 2*a* are characterized in that these traveling-wave array antennas are provided in juxtaposition with a predetermined interval $d_m$ (the interval $d_m$ is referred to as an interval between the center portions of their respective first slot pair antennas 61-1 and 62-1) from each other, that $\phi_m$=180 degrees, and that the traveling directions of electromagnetic waves within the rectangular waveguides 11*a* and 12*a* are opposite to each other. In addition, in the second preferred embodiment, the longitudinal direction of the center axes of the rectangular waveguides 11*a* and 12*a* are located on the Z-axis.

Referring to FIG. 5, a power-feeding rectangular waveguide 22*a* connected to a radio transmitter is branched into two by a power splitter 21*a* at a feeding point 20*a*, and the branched one is connected to a rectangular-shaped input opening 25*a* formed at the bottom surface of the −Z-axis side end portion of the rectangular waveguide 12*a* of the traveling-wave array antenna 2*a*. On the other hand, another branched one is connected via an attenuator 23*a* within the rectangular waveguide to a rectangular-shaped input opening 24*a* formed at the bottom surface of the +Z-axis side end portion of the rectangular waveguide 11*a* of the traveling-wave array antenna 1*a*.

On the top surface of the traveling-wave array antenna 2*a*, as shown in FIG. 6, a plurality of M pairs of slot pair antennas 62-m (m=1, 2, . . . , M), each of which is composed of an 2-long rectangular slot 64 and an L1-long rectangular slot 63 formed with a spacing of a predetermined slot interval h from each other are formed with a predetermined interval $d_2$ along the +Z-axis direction. In this case, a distance from the first slot pair antenna 62-1 to the −Z-axis direction side terminating portion of the rectangular waveguide 12*a* is set to a length of ¼ of the guide wavelength so that a non-reflective termination state (open impedance state) is obtained. On the other hand, a distance from the last slot pair antenna 62-M to the +Z-axis direction side terminating portion of the rectangular waveguide 12*a* is set to a length of ¼ of the guide wavelength so that a non-reflective termination state (open impedance state) is obtained.

Also, on the top surface of the traveling-wave array antenna 1*a*, in a manner similar to that of the traveling-wave array antenna 2*a*, a plurality of N pairs of slot pair antennas 61-1 to 61-N, each of which is composed of an L2'-long rectangular slot and an L1'-long rectangular slot formed in juxtaposition with a spacing of a predetermined slot interval h' from each other, are formed with a predetermined interval $d_1$ along the −Z-axis direction. In this case, a distance from the first slot pair antenna 61-1 to the +Z-axis direction side terminating portion of the rectangular waveguide 11*a* is set to a length of ¼ of the guide wavelength so that a non-reflective termination state (open impedance state) is obtained. On the other hand, a distance from the last slot pair antenna 61-N to the −Z-axis direction side terminating portion of the rectangular waveguide 11*a* is set to a length of ¼ of the guide wavelength so that a non-reflective termination state (open impedance state) is obtained.

Thus, the traveling-wave array antenna 1*a* of a waveguide slot array antenna including the plurality of N pairs of slot pair antennas 61-1 to 61-N formed on the rectangular waveguide 11*a* is made up, while the traveling-wave array antenna 2*a* of a waveguide slot array antenna including the plurality of M pairs of slot pair antennas 62-1 to 62-M formed on the rectangular waveguide 12*a* is made up. Furthermore, these two traveling-wave array antennas 1*a* and 2*a* are provided in juxtaposition in such a way that the traveling directions of electromagnetic waves within the rectangular waveguides 11*a* and 12*a* are opposite to each other, and this leads to a traveling-wave combining array antenna apparatus 102 being made up.

In the traveling-wave combining array antenna apparatus 102 constituted as described above, an electromagnetic wave of a transmitting signal outputted from a radio transmitter is split equally into two by the power splitter 21*a* provided at the feeding portion 20*a* via the power-feeding rectangular waveguide 22*a*, and one electromagnetic wave out of the two split waves is inputted into the rectangular waveguide 12*a* via the input opening 25*a* of the rectangular waveguide 12*a*, then traveling within the rectangular waveguide 12*a* toward its terminating portion along the +Z-axis direction. The electromagnetic wave travels within the rectangular waveguide 12*a*, and is radiated generally toward the Y-axis direction via the slot pair antennas 62-1 to 62-M. Also, the other electromagnetic wave of the two split waves is attenuated by a predetermined quantity of attenuation by the attenuator 23*a* within the rectangular waveguide, and then, is inputted into the rectangular waveguide 11*a* via the input opening 24*a* of the rectangular waveguide 11*a*, thereafter traveling within the rectangular waveguide 11*a* toward its terminating portion along the −Z-axis direction. The electromagnetic wave travels within the rectangular waveguide 11*a*, and is radiated generally toward the Y-axis direction via the slot pair antennas 61-1 to 61-N.

In the present preferred embodiment, the traveling-wave array antennas 1*a* and 2*a*, in which feeder lines are implemented by the rectangular waveguides 11*a* and 12*a*, have no unnecessary radiation from the feeder lines, and moreover, the traveling-wave array antennas 1*a* and 2*a* can be formed only by slot formation on the rectangular waveguides 11*a* and 12*a*. Thus, the present preferred embodiment has such a feature that the traveling-wave array antennas 1*a* and 2*a* can easily be formed.

In the present preferred embodiment, the excitation amplitude of the traveling-wave array antennas 1*a* and 2*a* can be controlled by changing the length or width of the rectangular slots of the slot pair antennas 61-1 to 61-N and 62-1 to 62-M, and the excitation phase of the traveling-wave array antennas 1*a* and 2*a* can be controlled by changing the antenna element interval of the slot pair antennas 61-1 to 61-N and 62-1 to 62-M. By controlling the excitation coefficients each including the excitation amplitude and the excitation phase, one traveling-wave array antenna 1*a* can be formed so as to have a vertical-plane radiating directivity characteristic of a narrow beam and a low side lobe, for example, in a manner similar to that of the first preferred embodiment, and the other traveling-wave array antenna 2*a* can be formed so as to have a vertical-plane radiating directivity characteristic of a cosecant-squared curve, for example, in a manner similar to that of the first preferred embodiment.

In a manner similar to that of the case of the general traveling-wave combining array antenna apparatus 101 as shown in the first preferred embodiment, when the frequency of a traveling electromagnetic wave has changed, the guide wavelength within the rectangular waveguides 11*a* and 12*a* is changed, so that the phase difference $\Delta\phi d$ between antenna elements due to a phase delay of traveling waves within the rectangular waveguides 11*a* and 12*a* is changed. Also, when the traveling electromagnetic wave passes just under the slots of the slot pair antennas 61-1 to 61-N and 62-1 to 62-M, there occurs a quantity of phase delay $\Delta\phi t$, and this phase delay $\Delta\phi t$ is also changed due to the frequency. As the frequency of the electromagnetic waves becomes higher, both of the phase difference $\Delta\phi d$ and the phase delay $\Delta\phi t$ increase, causing the excitation phase difference between the antenna elements to increase, so that the main-beam directions of the vertical-plane radiating directivity characteristics of the traveling-wave array antennas 1*a* and 2*a* rotate from the direction vertical to the Z-axis direction toward the traveling directions of the electromagnetic waves within the rectangular waveguides 11*a* and 12*a*, and thus the main beam directions thereof are largely inclined.

Conversely, as the frequency of the electromagnetic waves becomes lower, both of the phase difference $\Delta\phi d$ and the phase delay $\Delta\phi t$ decrease, so that the main-beam directions of the vertical-plane radiating directivity characteristics of the traveling-wave array antennas 1*a* and 2*a* rotate from the direction vertical to the Z-axis direction toward the direction opposite to the traveling directions of the electromagnetic waves within the rectangular waveguides 11*a* and 12*a*, and thus the main beam directions thereof are largely inclined.

In this case, since the two traveling-wave array antennas 1*a* and 2*a* are provided in juxtaposition in such a manner that the traveling directions of the electromagnetic waves within the rectangular waveguides 11*a* and 12*a* of the traveling-wave array antennas 1*a* and 2*a* become opposite to each other, the variation of the main-beam direction due to a frequency change $\Delta f$ of the electromagnetic wave can be canceled and suppressed for the traveling-wave combining array antenna apparatus 102 of the whole array antenna.

Also, since the attenuator 23*a* is provided on the rectangular waveguide that is one of the branches from the power splitter 21*a* so that the power of the electromagnetic wave to be supplied to the rectangular waveguide 11*a* of the traveling-wave array antenna 1*a* is reduced, the variation $\Delta\theta$ of the main-beam direction corresponding to the frequency change $\Delta f$ for the whole array antenna of the traveling-wave combining array antenna apparatus 102 can be controlled, in a manner similar to that of the first preferred embodiment. In the present preferred embodiment, the power fed to the traveling-wave array antenna 1*a* having the directivity characteristic of the narrow beam and the low side lobe is reduced. As a result, the power radiated from the traveling-wave array antenna 2*a* having the vertical-plane radiating directivity characteristic of the cosecant-squared curve becomes predominant, and the vertical-plane radiating directivity characteristic of the whole traveling-wave combining array antenna apparatus 102 become close to the vertical-plane radiating directivity characteristic of the cosecant-squared curve. Further, as to the change in the main-beam direction of the traveling-wave combining array antenna apparatus 102, those of the traveling-wave array antenna 2*a* also becomes predominant, and the variation $\Delta\theta$ of the main-beam direction for the whole traveling-wave combining array antenna apparatus 102 can be suppressed by using the vertical-plane radiating directivity characteristic which has a larger change in the main-beam direction corresponding to the frequency change $\Delta f$ of the traveling-wave array antenna 1*a*.

Next, the results of a simulation on the traveling-wave combining array antenna apparatus 102 according to the second preferred embodiment shown in FIGS. 5 and 6 are shown. In the traveling-wave array antenna 2*a*, disposing two rectangular slots 63 and 64 separate from each other by about a half-wavelength (=h) as shown in FIG. 6 produces such an effect of suppression of reflected wave, which is also the case with the traveling-wave array antenna 1*a*. In an implemental example of this second preferred embodiment, the rectangular waveguides 11*a* and 12*a* of 7 mm wide and 3.2 mm high are used, and a dielectric having a dielectric constant of 2.2 is filled in those rectangular waveguides 11*a* and 12*a*. Further, the rectangular slots 63 and 64 of 4 mm wide are formed in the rectangular waveguides 11*a* and 12*a* of the traveling-wave array antennas 1*a* and 2*a*, thus making up a so-called slot pair array antenna.

When constituent parameters of the respective antenna elements of the traveling-wave array antenna 1*a* made up of 16 elements (N=16) are set as shown in the following Table 3, the predetermined vertical-plane radiating directivity characteristic of the narrow beam and the low side lobe can be obtained as shown below.

TABLE 3

| Element No. | Position in Z-axis direction | Length L1' | Length L2' | Interval h' |
|---|---|---|---|---|
| 1 | 0.000 | 1.988 | 1.988 | 2.351 |
| 2 | 11.605 | 2.370 | 2.386 | 2.338 |
| 3 | 20.791 | 2.929 | 2.966 | 2.268 |
| 4 | 29.798 | 3.332 | 3.384 | 2.148 |
| 5 | 38.564 | 3.632 | 3.697 | 2.035 |
| 6 | 47.053 | 3.820 | 3.892 | 1.884 |
| 7 | 55.203 | 3.950 | 4.024 | 1.741 |
| 8 | 62.998 | 4.045 | 4.123 | 1.608 |
| 9 | 70.409 | 4.120 | 4.197 | 1.486 |
| 10 | 77.381 | 4.191 | 4.259 | 1.364 |
| 11 | 83.875 | 4.255 | 4.310 | 1.245 |
| 12 | 90.020 | 4.279 | 4.328 | 1.194 |
| 13 | 96.327 | 4.207 | 4.272 | 1.335 |
| 14 | 103.454 | 4.031 | 4.108 | 1.631 |
| 15 | 111.684 | 3.674 | 3.740 | 2.011 |
| 16 | 120.501 | 3.313 | 3.365 | 2.154 |

The excitation coefficients each including an excitation amplitude and an excitation phase for the traveling-wave array antenna 1*a* are shown in the following Table 4.

TABLE 4

| Element No. | f1 Excitation amplitude | f1 Excitation phase | f0 Excitation amplitude | f0 Excitation phase | f2 Excitation amplitude | f2 Excitation phase |
|---|---|---|---|---|---|---|
| 1 | −25.376 | 0.000 | −25.574 | 0.000 | −25.995 | 0.000 |
| 2 | −20.638 | 20.990 | −20.867 | 16.831 | −21.195 | 12.678 |
| 3 | −13.680 | 41.947 | −13.827 | 33.586 | −14.097 | 25.203 |
| 4 | −8.724 | 62.977 | −8.783 | 50.216 | −8.965 | 37.415 |
| 5 | −5.134 | 84.287 | −5.104 | 66.672 | −5.187 | 48.940 |
| 6 | −2.598 | 106.246 | −2.490 | 82.916 | −2.485 | 59.226 |
| 7 | −0.967 | 129.419 | −0.820 | 98.908 | −0.769 | 67.371 |
| 8 | −0.143 | 154.571 | −0.019 | 114.631 | 0.000 | 72.043 |
| 9 | 0.000 | 182.649 | 0.000 | 130.047 | −0.170 | 71.376 |
| 10 | −0.576 | 215.045 | −0.824 | 145.141 | −1.424 | 62.756 |
| 11 | −1.852 | 253.117 | −2.503 | 159.901 | −3.779 | 44.314 |
| 12 | −3.906 | 297.181 | −5.114 | 174.384 | −7.013 | 16.666 |
| 13 | −7.031 | 343.728 | −8.791 | 189.006 | −10.860 | −13.554 |
| 14 | −11.531 | 379.843 | −13.825 | 204.293 | −16.441 | −27.132 |
| 15 | −18.172 | 405.434 | −20.846 | 220.366 | −23.932 | −22.445 |
| 16 | −22.852 | 427.126 | −25.660 | 236.874 | −28.890 | −11.276 |

Figure 7A:
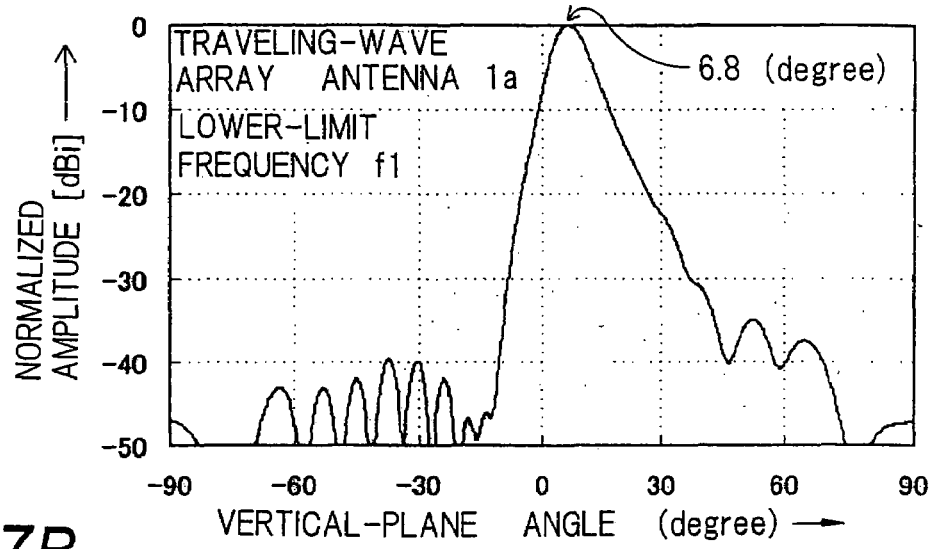
FIG. 7A is a graph showing a radiating pattern (normalized amplitude) versus a vertical-plane angle of a traveling-wave array antenna 1*a* of FIG. 5 with a lower-limit frequency of f1.
Figure 7B:
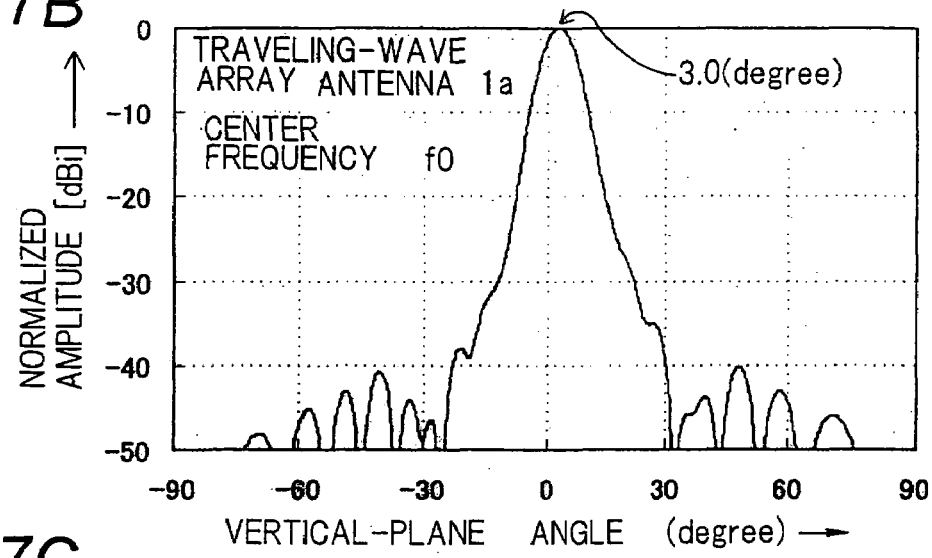
FIG. 7B is a graph showing a radiating pattern (normalized amplitude) versus a vertical-plane angle of the traveling-wave array antenna 1*a* of FIG. 5 with a center frequency of f0.
Figure 7C:
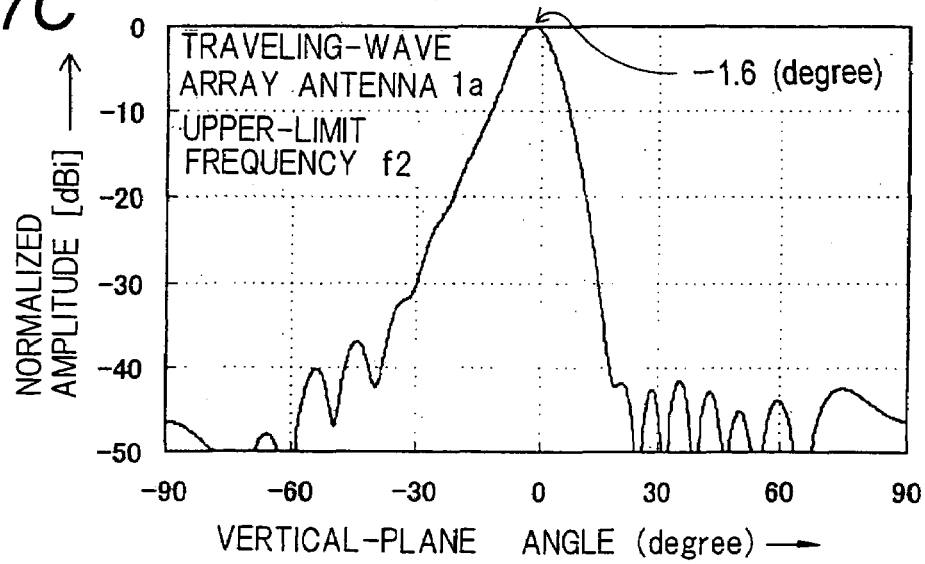
FIG. 7C is a graph showing a radiating pattern (normalized amplitude) versus a vertical-plane angle of the traveling-wave array antenna 1*a* of FIG. 5 with an upper-limit frequency of f2.

The results of calculating array factors at respective frequencies, f1=25.27 GHz, f0=25.48 GHz and f2=25.69 GHz, of the travleing-wave array antenna 1*a* having the above settings are shown in FIGS. 7A, 7B and 7C, respectively. The array factors were calculated with the above-mentioned phase differences Δϕd, Δϕt included in the excitation phases. In FIGS. 7A, 7B and 7C, a front-facing direction vertical to the Z-axis of the traveling-wave array antenna 1*a* is assumed as 0 degrees, and angles of inclination resulting from rotation (counterclockwise rotation) from the front-facing direction toward the traveling direction of the electromagnetic wave within the rectangular waveguide 11*a* are assumed as positive angles.

As apparent from FIGS. 7A, 7B and 7C, a predetermined vertical-plane radiating directivity characteristic of a narrow beam and a low side lobe can be obtained in the traveling-wave array antenna 1*a*. Also, the variation Δθd of the main beam at the lower-limit frequency f1 is +6.8 degrees, the variation Δθd of the main beam at the center frequency f0 is +3.0 degrees, and the variation Δθd of the main beam at the upper-limit frequency f2 is −1.6 degrees.

Next, in a manner similar to above, when the constituent parameters of the antenna elements of the traveling-wave array antenna 2*a* made up of 16 elements (M=16) are set as shown in the following Table 5, a vertical-plane radiating directivity characteristic of a cosecant-squared curve can be obtained as shown below.

TABLE 5

| Element No. | Position in Z-axis direction | Length L1 | Length L2 | Interval h |
|---|---|---|---|---|
| 1 | 0 | 3.783 | 3.857 | 1.878 |
| 2 | 9.602181206 | 3.803 | 3.877 | 1.86 |
| 3 | 18.61618393 | 3.82 | 3.895 | 1.844 |
| 4 | 27.45225815 | 3.838 | 3.914 | 1.826 |
| 5 | 36.24385207 | 3.845 | 3.921 | 1.818 |
| 6 | 45.02319713 | 3.865 | 3.941 | 1.796 |
| 7 | 53.65639566 | 3.899 | 3.975 | 1.758 |
| 8 | 62.18699823 | 3.913 | 3.989 | 1.74 |
| 9 | 70.74035222 | 3.925 | 4.001 | 1.726 |
| 10 | 79.17009039 | 3.962 | 4.04 | 1.678 |
| 11 | 87.35028052 | 3.995 | 4.072 | 1.632 |
| 12 | 95.49388806 | 4.001 | 4.078 | 1.624 |
| 13 | 103.601063 | 4.039 | 4.115 | 1.564 |
| 14 | 111.1569233 | 4.129 | 4.203 | 1.398 |

TABLE 5-continued

| Element No. | Position in Z-axis direction | Length L1 | Length L2 | Interval h |
|---|---|---|---|---|
| 15 | 117.8299446 | 4.223 | 4.29 | 1.19 |
| 16 | 124.4650918 | 4.187 | 4.256 | 1.276 |

The excitation coefficients each including an excitation amplitude and an excitation phase for the traveling-wave array antenna 2*a* are shown in the following Table 6.

TABLE 6

| Element No. | f1 Excitation amplitude | f1 Excitation phase | f0 Excitation amplitude | f0 Excitation phase | f2 Excitation amplitude | f2 Excitation phase |
|---|---|---|---|---|---|---|
| 1 | 0.000 | 0.000 | 0.000 | 0.000 | 0.000 | 0.000 |
| 2 | −0.128 | −33.907 | −0.162 | −36.911 | −0.204 | −40.446 |
| 3 | −0.320 | −47.101 | −0.394 | −53.340 | −0.485 | −60.712 |
| 4 | −0.524 | −55.033 | −0.643 | −64.752 | −0.787 | −76.278 |
| 5 | −0.942 | −62.242 | −1.118 | −75.672 | −1.334 | −91.661 |
| 6 | −1.173 | −70.263 | −1.401 | −87.572 | −1.681 | −108.242 |
| 7 | −1.226 | −75.370 | −1.504 | −96.976 | −1.845 | −122.886 |
| 8 | −1.668 | −78.652 | −2.024 | −105.139 | −2.463 | −137.101 |
| 9 | −2.182 | −83.999 | −2.624 | −115.673 | −3.173 | −154.117 |
| 10 | −2.299 | −87.740 | −2.812 | −125.086 | −3.451 | −170.697 |
| 11 | −2.642 | −86.428 | −3.261 | −130.568 | −4.040 | −184.969 |
| 12 | −3.538 | −85.588 | −4.308 | −137.481 | −5.287 | −202.119 |
| 13 | −3.941 | −87.098 | −4.849 | −147.328 | −6.018 | −223.089 |
| 14 | −3.754 | −79.419 | −4.802 | −150.693 | −6.230 | −241.969 |
| 15 | −4.338 | −56.837 | −5.742 | −146.767 | −7.941 | −265.426 |
| 16 | −7.129 | −33.627 | −9.108 | −152.645 | −11.584 | −313.366 |

Figure 8A:
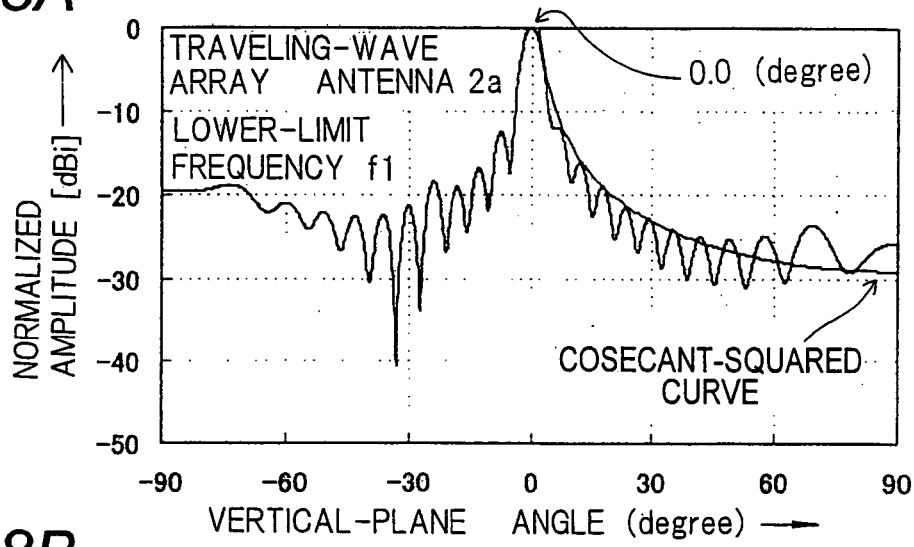
FIG. 8A is a graph showing a radiating pattern (normalized amplitude) versus a vertical-plane angle of a traveling-wave array antenna 2*a* of FIG. 5 with a lower-limit frequency of f1.
Figure 8B:
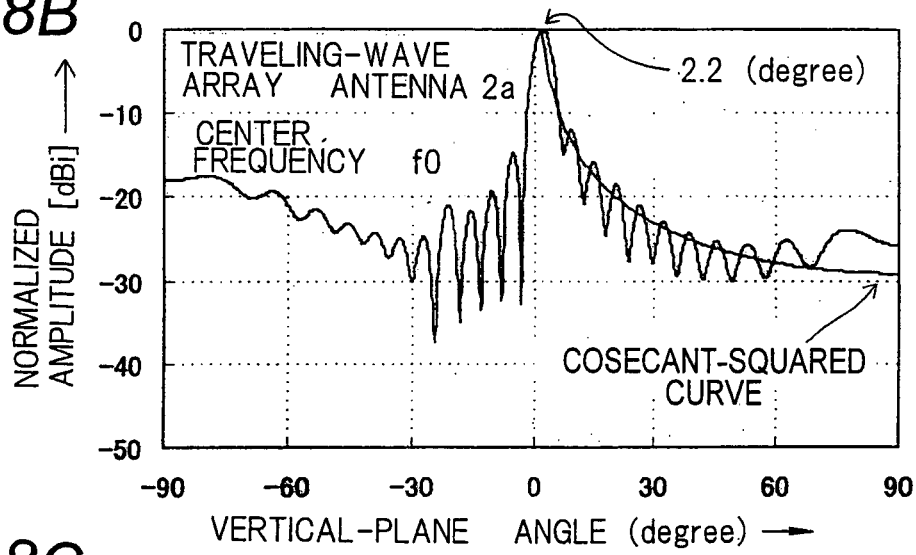
FIG. 8B is a graph showing a radiating pattern (normalized amplitude) versus a vertical-plane angle of the traveling-wave array antenna 2*a* of FIG. 5 with a center frequency of f0.
Figure 8C:
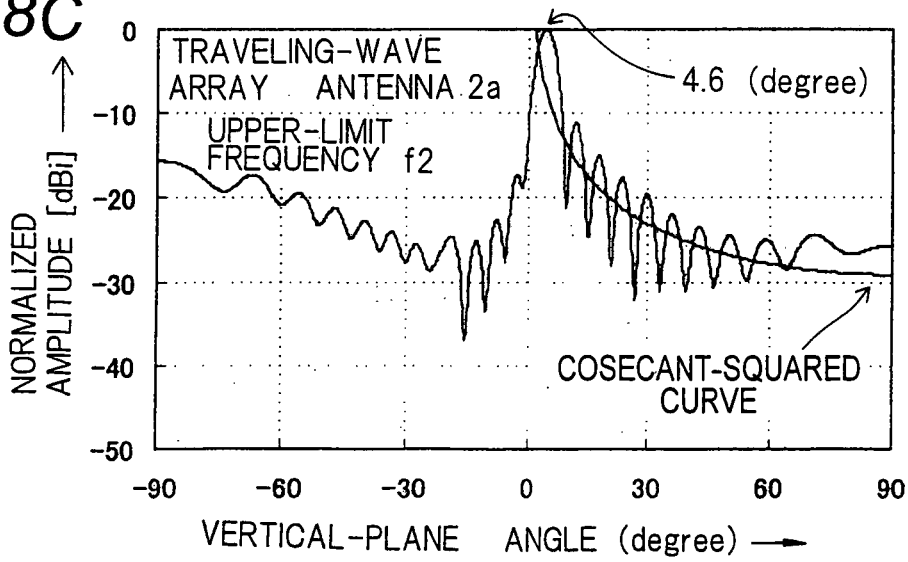
FIG. 8C is a graph showing a radiating pattern (normalized amplitude) versus a vertical-plane angle of the traveling-wave array antenna 2*a* of FIG. 5 with an upper-limit frequency of f2.

The results of calculating array factors at respective frequencies, f1=25.27 GHz, f0=25.48 GHz and f2=25.69 Hz, of the traveling-wave array antenna 2*a* having the above settings are shown in FIGS. 8A, 8B and 8C, respectively. The array factors were calculated with the above-mentioned phase differences Δϕd and Δϕt included in the excitation phases. In FIGS. 8A, 8B and 8C, a front-facing direction vertical to the Z-axis of the traveling-wave array antenna 2*a* is assumed as 0 degrees, and the angles of inclination resulting from rotation (clockwise rotation) from the front-facing direction toward the traveling direction of the electromagnetic wave within the rectangular waveguide 12*a* are assumed as positive angles.

As apparent from FIGS. 8A, 8B and 8C, a vertical-plane radiating directivity characteristic of a cosecant-squared curve can be obtained in the traveling-wave array antenna 2*a*. Also, the variation Δθc of the main beam at the lower-limit frequency f1 corresponding to the frequency change Δf is 0.0 degrees, the variation Δθc of the main beam at the center frequency f0 is +2.2 degrees, and the variation Δθc of the main beam at the upper-limit frequency f2 is +4.6 degrees.

These traveling-wave array antennas 1*a* and 2*a* are disposed with a predetermined distance $d_m$=35 mm from each other so that the traveling directions of the electromagnetic waves within the rectangular waveguides 11*a* and 12*a* are opposite to each other as shown in FIG. 5, and the attenuation quantity of the attenuator 23*a* is set to 5 dB. The array factors at the frequencies f1, f0 and f2 in the traveling-wave combining array antenna apparatus 102 equipped with the two traveling-wave array antennas 1*a* and 2*a* in this case are shown in FIGS. 9A, 9B and 9C, respectively.

Figure 9A:
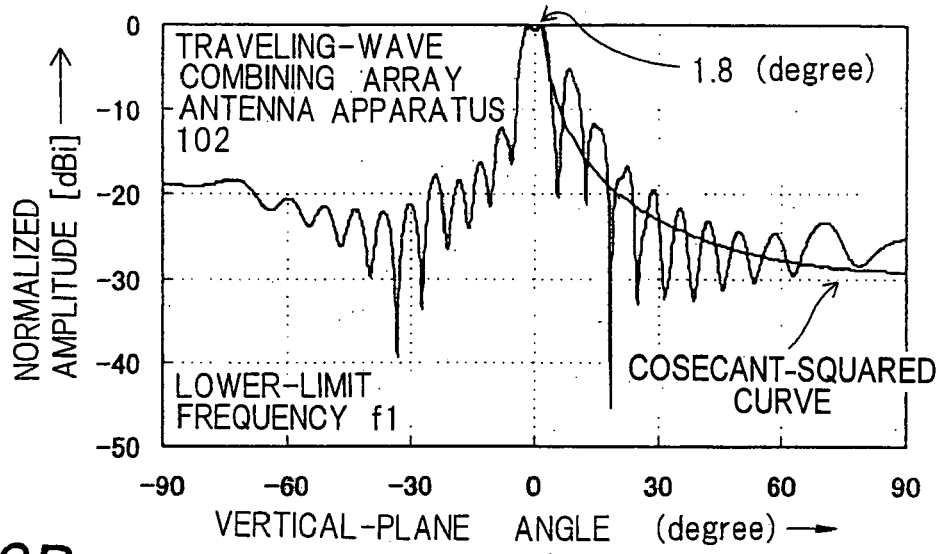
FIG. 9A is a graph showing a radiating pattern (normalized amplitude) versus a vertical-plane angle of the traveling-wave combining array antenna apparatus 102 of FIG. 5 with a lower-limit frequency of f1.
Figure 9B:
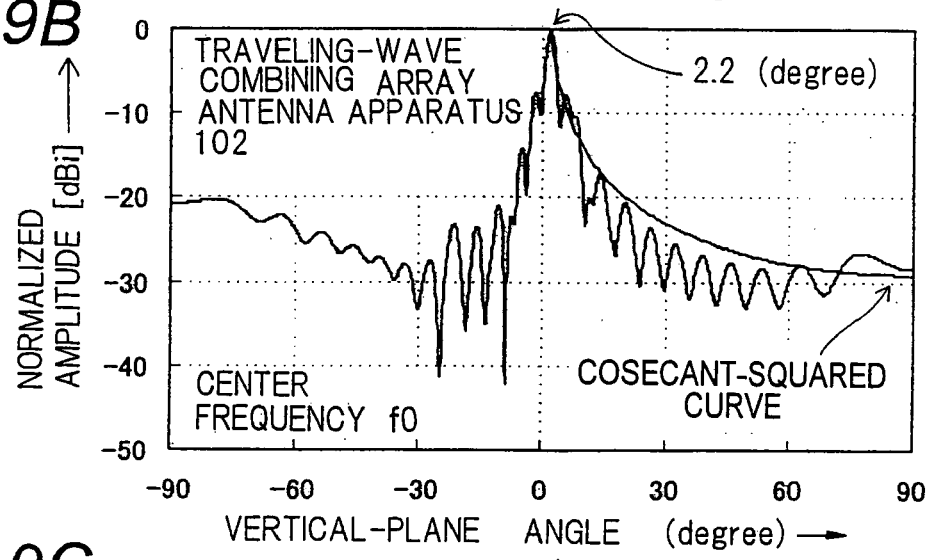
FIG. 9B is a graph showing a radiating pattern (normalized amplitude) versus a vertical-plane angle of the traveling-wave combining array antenna apparatus 102 of FIG. 5 with a center frequency of f0.
Figure 9C:
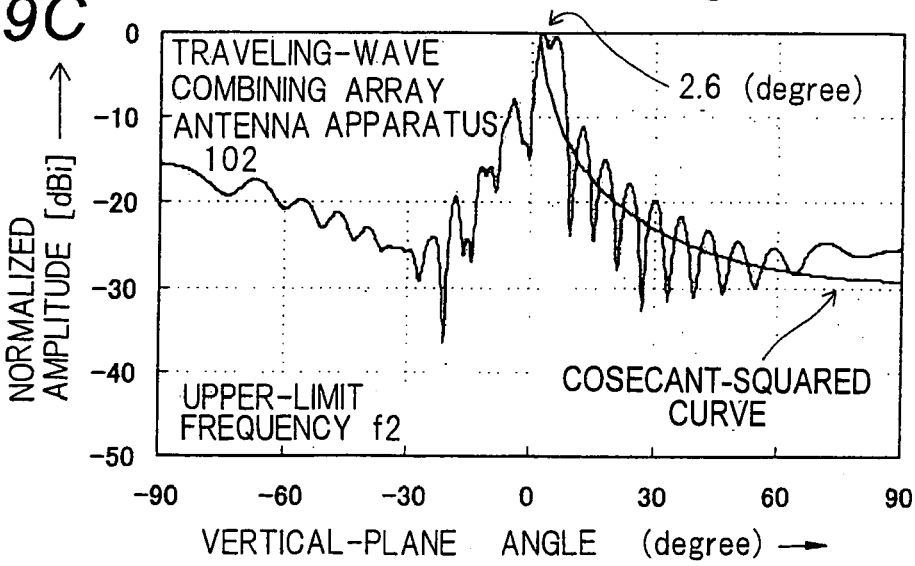
FIG. 9C is a graph showing a radiating pattern (normalized amplitude) versus a vertical-plane angle of the traveling-wave combining 25 array antenna apparatus 102 of FIG. 5 with an upper-limit frequency of f2.

As apparent from FIGS. 9A, 9B and 9C, a vertical-plane radiating directivity characteristic of a cosecant-squared curve can be obtained in the traveling-wave combining array antenna apparatus 102. Also, the variation Δθc of the main beam at the lower-limit frequency f1 corresponding to the frequency change Δf is +1.8 degrees, the variation Δθc of the main beam at the center frequency f0 is +2.2 degrees, and the variation Δθc of the main beam at the upper-limit frequency f2 is +2.6 degrees. That is, whereas the variation Δθ of the main beam corresponding to the frequency change Δf in the traveling-wave array antenna 2*a* having the vertical-plane radiating directivity characteristic of the cosecant-squared curve shown in FIGS. 8A, 8B and 8C is 4.6 degrees, the variation Δθ of the main beam corresponding to the frequency change Δf can be suppressed to 0.8 degree in the traveling-wave combining array antenna apparatus 102 further equipped with the traveling-wave array antenna 1*a* having the vertical-plane radiating directivity characteristic of the narrow beam and the low side lobe shown in FIGS. 7A, 7B and 7C.

Also, as a result of attenuating the excitation of the traveling-wave array antenna 1*a* having the directivity characteristic of the narrow beam and the low side lobe by the attenuator 23*a*, the vertical-plane radiating directivity characteristic of the cosecant-squared curve has been obtained. Further, since the traveling-wave array antenna 1*a* used shows a change, 8.4 degrees, of the main-beam direction corresponding to the frequency change Δf, larger than the change of the main-beam direction corresponding to the frequency change Δf of the traveling-wave array antenna 2*a*, the variation Δθ of the main beam can be suppressed even if the excitation is weakened.

As described above, according to the present preferred embodiment, by the arrangement that the two traveling-wave array antennas 1*a* and 2*a* are provided in juxtaposition so that the traveling directions of the electromagnetic waves within the rectangular waveguides 11*a* and 12*a* become opposite to each other, the variation Δθ of the main beam in the vertical-plane radiating directivity characteristic corresponding to the frequency change Δf can be suppressed.

THIRD PREFERRED EMBODIMENT

Figure 10:
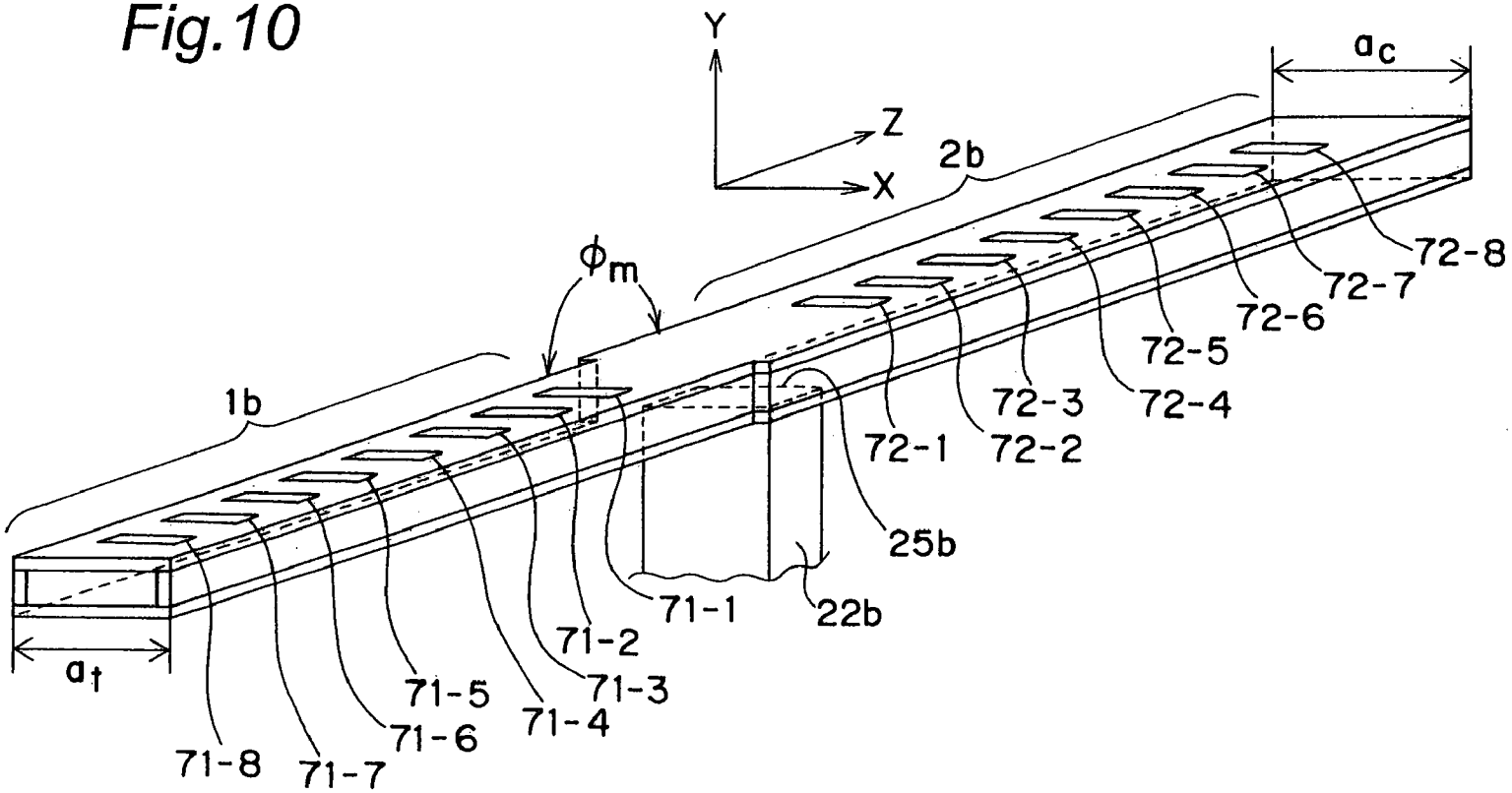
FIG. 10 is a perspective view showing a constitution of a traveling-wave combining array antenna apparatus 103 of a third preferred embodiment according to the present invention.
Figure 11:
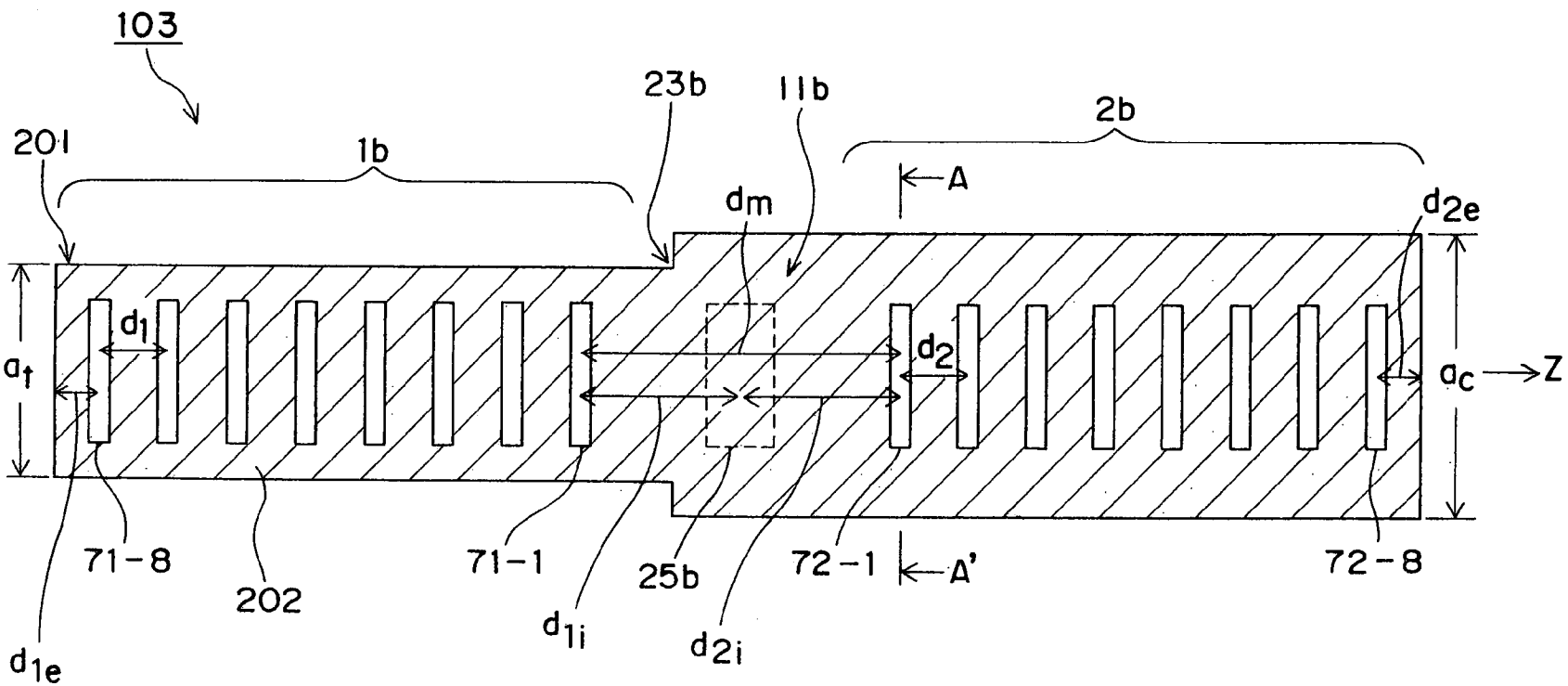
FIG. 11 is a top view of the traveling-wave combining array antenna apparatus 103 of FIG. 10.
Figure 12:
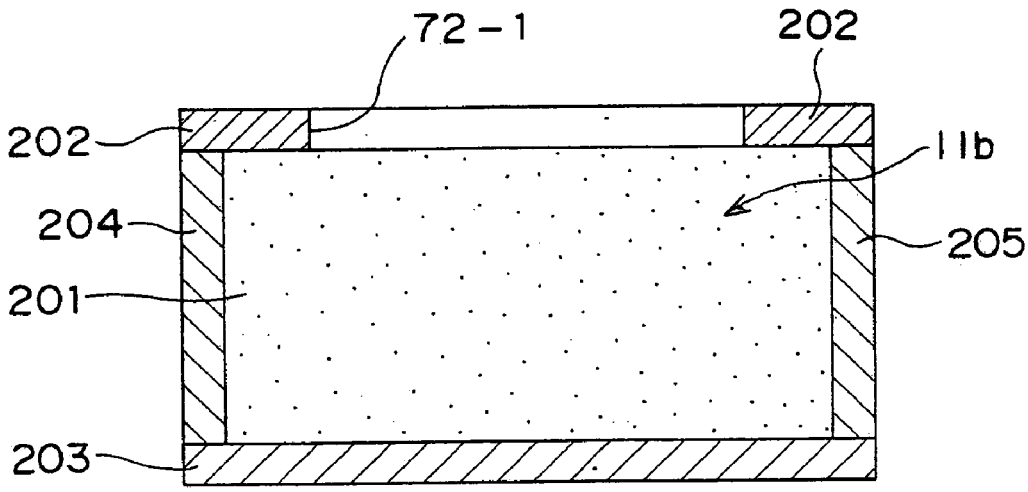
FIG. 12 is a longitudinal sectional view taken along the A–A' plane of FIG. 11.

FIG. 10 is a perspective view showing a constitution of a traveling-wave combining array antenna apparatus 103 of a third preferred embodiment according to the present invention, FIG. 11 is a top view of the traveling-wave combining array antenna apparatus 103 of FIG. 10, and FIG. 12 is a longitudinal sectional view taken along the A–A' plane of FIG. 11. The traveling-wave combining array antenna apparatus 103 according to this third preferred embodiment is characterized in that traveling-wave array antennas 1*b* and 2*b*, which are slot array antennas formed on a dielectric substrate 201, are provided in juxtaposition in such a manner that traveling directions of electromagnetic waves traveling along a feeder line within the dielectric substrate 201 become opposite to each other ($\phi_m$=180 degrees).

Referring to FIG. 12, on the dielectric substrate 201, an upper-surface conductor 202 is formed on its top surface while a lower-surface conductor 203 is formed on its bottom surface, and moreover side-face conductors 204 and 205 are formed on the two side surfaces, respectively, and end conductors (not shown) are formed at longitudinal end portions of the dielectric substrate 201, respectively, thus the dielectric substrate 201 constituting a pseudo power-feeding rectangular waveguide 11*b*. As shown in FIGS. 10 and 11, the width of the dielectric substrate 201 on the traveling-wave array antenna 1*b* side is set to $a_t$, and the widths of the dielectric substrate 201 both on a traveling-wave array antenna 2*b* side and at a central portion are set to $a_c$ (>$a_t$). Further, eight rectangular slots are formed in the upper-surface conductor 202 on the traveling-wave array antenna 1*b* side of the dielectric substrate 201 at a predetermined antenna element interval $d_1$ along the −Z-axis direction by, for example, etching process, and this leads to formation of a slot array antenna having eight slot antennas 71-1 to 71-8, thus constituting the traveling-wave array antenna 1*b*. On the other hand, eight rectangular slots are formed in the upper-surface conductor 202 on the traveling-wave array antenna 2*b* side of the dielectric substrate 201 at a predetermined antenna element interval $d_2$ along the +Z-axis direction by, for example, etching process, and this leads to formation of a slot array antenna having eight slot antennas 72-1 to 72-8, thus constituting the traveling-wave array antenna 2*b*. It is noted that each of the rectangular slots is so formed that its longitudinal direction is parallel to a direction vertical to the Z-axis.

The spacing between the two traveling-wave array antennas 1*b* and 2*b*, i.e., the spacing between their first slot antennas 71-1 and 72-1, is set to a predetermined spacing distance $d_m$. Also, a rectangular-shaped input opening 25*b* for connecting the power-feeding rectangular waveguide is formed in the lower-surface conductor 203 at the longitudinally central portion of the dielectric substrate 201, an interval $d_{1i}$ from the center to the first slot antenna 71-1 is set to an integral multiple of a ¼ wavelength of the guide wavelength so as to make a non-reflective termination state (open impedance state), and an interval $d_{2i}$ from the center of the input opening 25*b* to the first slot antenna 72-1 is set to an integral multiple of the ¼ wavelength of the guide wavelength so as to make a non-reflective termination state (open impedance state). Further, an interval $d_{1e}$ from the eighth slot antenna 71-8 to the nearby end conductor (not shown) is also set to an integral multiple of the ¼ wavelength of the guide wavelength so as to make a non-reflective termination state (open impedance state), and an interval $d_{2e}$ from the eighth slot antenna 72-8 to the nearby end conductor (not shown) is still also set to an integral multiple of the ¼ wavelength of the guide wavelength so as to make a non-reflective termination state (open impedance state).

As described above, the width of the dielectric substrate 201 on the traveling-wave array antenna 1*b* side is set to $a_t$, the widths of the dielectric substrate 201 both on the traveling-wave array antenna 2*b* side and at the central portion are set to $a_c$, and a portion where the width of the dielectric substrate 201 abruptly changes is formed between the input opening 25*b* and the first slot antenna 71-1, and this leads to formation of an attenuator portion 23*b*. In addition, in the present preferred embodiment, a distance from the Z-axis to widthwise end edge portions in the traveling-wave array antenna 1*b* is set to $a_t/2$ in the traveling-wave array antenna 1*b*, and a distance from the Z-axis to widthwise end edge portions is set to $a_c/2$ in the traveling-wave array antenna 2*b*.

In the traveling-wave combining array antenna apparatus 103 constituted as described above, an electromagnetic wave of a transmitting signal inputted from the power-feeding rectangular waveguide (not shown) via the input opening 25*b* is split into two waves in the rectangular waveguide 11*b* located just above the input opening 25*b*. One electromagnetic wave out of the two split waves travels in the rectangular waveguide 11*b* within the traveling-wave array antenna 2*b* along the Z-axis direction, and is radiated via the slot antennas 72-1 to 72-8. The other electromagnetic wave is subjected to a predetermined attenuation by the attenuator portion 23*b*, and thereafter, travels in the rectangular waveguide 11*b* within the traveling-wave array antenna 1*b* along the −Z-axis direction, and is radiated via the slot antennas 71-1 to 71-8.

In the traveling-wave combining array antenna apparatus 103 constituted as described above, one input opening 25*b* is provided, and the two traveling-wave array antennas 1*b* and 2*b* are formed integrally by using the dielectric substrate 201. The excitation amplitudes for the traveling-wave array antennas 1*b* and 2*b* can be controlled by changing the respective lengths or widths of the respective slot antennas 71-1 to 71-8 and 72-1 to 72-8, and the excitation phases for the traveling-wave array antennas 1*b* and 2*b* can be controlled by changing the antenna element distances $d_1$ and $d_2$, respectively. By controlling the excitation coefficients each including the excitation amplitude and the excitation phase, one traveling-wave array antenna 1*b* can be made so as to have the predetermined vertical-plane radiating directivity characteristic of the narrow beam and the low side lobe in a manner similar to that of the first preferred embodiment, and the other traveling-wave array antenna 2*b* can be made so as to have the predetermined vertical-plane radiating directivity characteristic of the cosecant-squared curve in a manner similar to that of the first preferred embodiment.

By the provision of the two traveling-wave array antennas 1*b* and 2*b* that allow propagating electromagnetic waves to travel in mutually opposite directions within the pseudo power-feeding rectangular waveguide 11*b*, the main-beam directions of the vertical-plane radiating directivity characteristic of the traveling-wave array antennas 1*b* and 2*b* corresponding to the frequency change Δf are changed in mutually opposite directions, so that the variation Δθ of the main-beam direction for the whole traveling-wave combining array antenna apparatus 103 can be suppressed. In this case, since one traveling-wave array antenna 1*b* has the predetermined vertical-plane radiating directivity characteristic of narrow beam and the low side lobe, the vertical-plane radiating directivity characteristic of the traveling-wave combining array antenna apparatus 103 becomes the radiating directivity characteristic similar to the vertical-plane radiating directivity characteristic of the cosecant-squared curve of the other traveling-wave array antenna 2*b*.

Also, by the arrangement that the waveguide width of the traveling-wave array antenna 1*b* is set to $a_t$ so as to be smaller than the waveguide width $a_c$ of the traveling-wave array antenna 1*b*, the input impedances of the two traveling-wave array antennas 1*b* and 2*b* are different from each other, when the rectangular waveguide 11*b* of each traveling-wave array antenna 1*b* and 2*b* is seen from the input opening 25*b*, so that the electromagnetic waves inputted to the two traveling-wave array antennas 1*b* and 2*b* can be given a difference in power therebetween. In other words, the electromagnetic wave inputted to the traveling-wave array antenna 1*b* is subjected to an attenuation by the attenuator portion 23*b*. Thus, since the power of the electromagnetic wave to be fed to the traveling-wave array antenna 1*b* is made smaller than that of the traveling-wave array antenna 2*b*, the radiation power of the traveling-wave array antenna 1*b* also becomes smaller, so that the power of the electromagnetic wave radiated from the traveling-wave array antenna 2*b* becomes predominant. Accordingly, the vertical-plane radiating directivity characteristic of the traveling-wave combining array antenna apparatus 103 becomes further closer to the vertical-plane radiating directivity characteristic of the cosecant-squared curve.

By the arrangement that the waveguide width of the traveling-wave array antenna 1*b* is made smaller than that of the traveling-wave array antenna 2*b*, the radiation power becomes smaller, whereas the variation of the guide wavelength corresponding to the frequency change Δf becomes larger, so that the variation Δθ of the main-beam direction of the vertical-plane radiating directivity characteristic of the traveling-wave array antenna 1*b* becomes larger than that of the vertical-plane radiating directivity characteristic of the cosecant-squared curve of the traveling-wave array antenna 1*b*. Since these two factors complement each other, the whole traveling-wave combining array antenna apparatus 103 is enabled to suppress the variation Δθ of the main-beam direction while maintaining the vertical-plane radiating directivity characteristic of the cosecant-squared curve.

In the above-mentioned preferred embodiment, the attenuator portion 23*b* is formed by giving a difference in the waveguide width to the two traveling-wave array antennas 1*b* and 2*b*. Otherwise, by giving a difference in the waveguide height to the two traveling-wave array antennas 1*b* and 2*b*, similar effects can be obtained.

Also, interior of the rectangular waveguide 11*b* made by the dielectric substrate 201 may be either hollow or filled with a dielectric. The guide wavelength within the rectangular waveguide 11*b* can be reduced depending on the dielectric constant of the dielectric to be filled. As a result of this, not only can the whole traveling-wave combining array antenna apparatus 103 be made smaller in size, but also the distance between the slot antenna elements can be reduced, so that the grating lobe of the vertical-plane radiating directivity characteristic can be suppressed to a large extent. For example, when the dielectric constant of the traveling-wave array antenna 1*b* is larger than the dielectric constant of the traveling-wave array antenna 2*b*, the guide wavelength of the rectangular waveguide 11*b* of the traveling-wave array antenna 1*b* can be made smaller than the guide wavelength of the rectangular waveguide 11*b* of the traveling-wave array antenna 2*b*, so that the quantity of propagation attenuation in the traveling-wave array antenna 1*b* during propagation of an electromagnetic wave having a predetermined wavelength can be made larger than the quantity of propagation attenuation in the traveling-wave array antenna 2*b* while the above-mentioned quantity of phase delay in the traveling-wave array antenna 1*b* can be made larger than the quantity of phase delay in the traveling-wave array antenna 2*b*.

Furthermore, in terms of the dielectric constant of the dielectric substrate 201, it may be also arranged that the dielectric constant of the dielectric substrate 201 of the traveling-wave array antenna 1*b* and the dielectric constant of the dielectric substrate 201 of the traveling-wave array antenna 2*b* are different from each other. As described above, since the guide wavelength changes depending on the dielectric constant of the dielectric substrate 201, giving a difference between the variations Δθ of the main-beam directions of the vertical-plane radiating directivity characteristics of the two traveling-wave array antennas 1*b* and 2*b* by filling dielectrics having different dielectric constants into the rectangular waveguides 11*b* of the traveling-wave array antennas 1*b* and 2*b*, respectively, makes it implementable to control the variations of the main-beam directions for the whole traveling-wave combining array antenna apparatus 103.

Although a rectangular waveguide is used in the above-mentioned preferred embodiment, transmission lines of other configurations such as circular waveguides may be also used.

FOURTH PREFERRED EMBODIMENT

Figure 13:
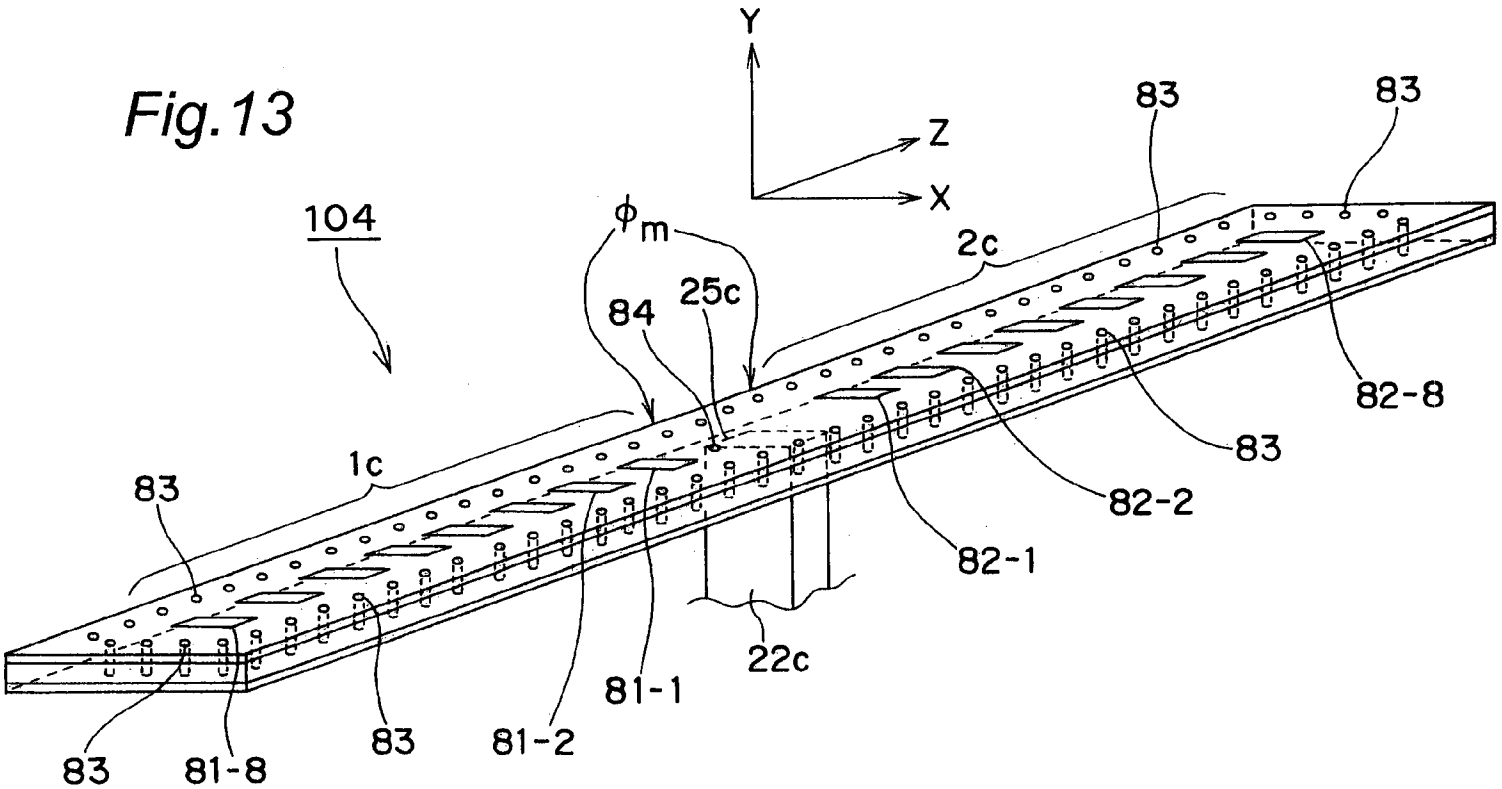
FIG. 13 is a perspective view showing a constitution of a traveling-wave combining array antenna apparatus 104 of a fourth preferred embodiment according to the present invention.
Figure 14:
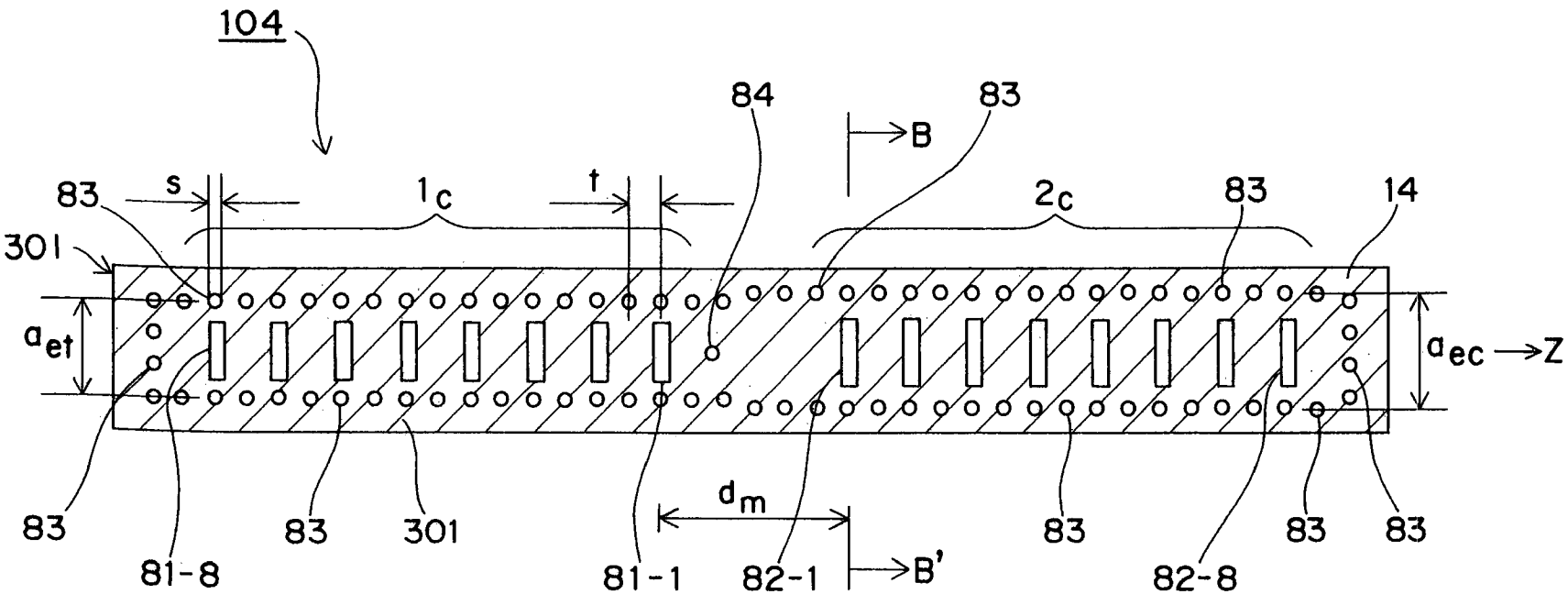
FIG. 14 is a top view of the traveling-wave combining array antenna apparatus 104 of FIG. 13.
Figure 15:
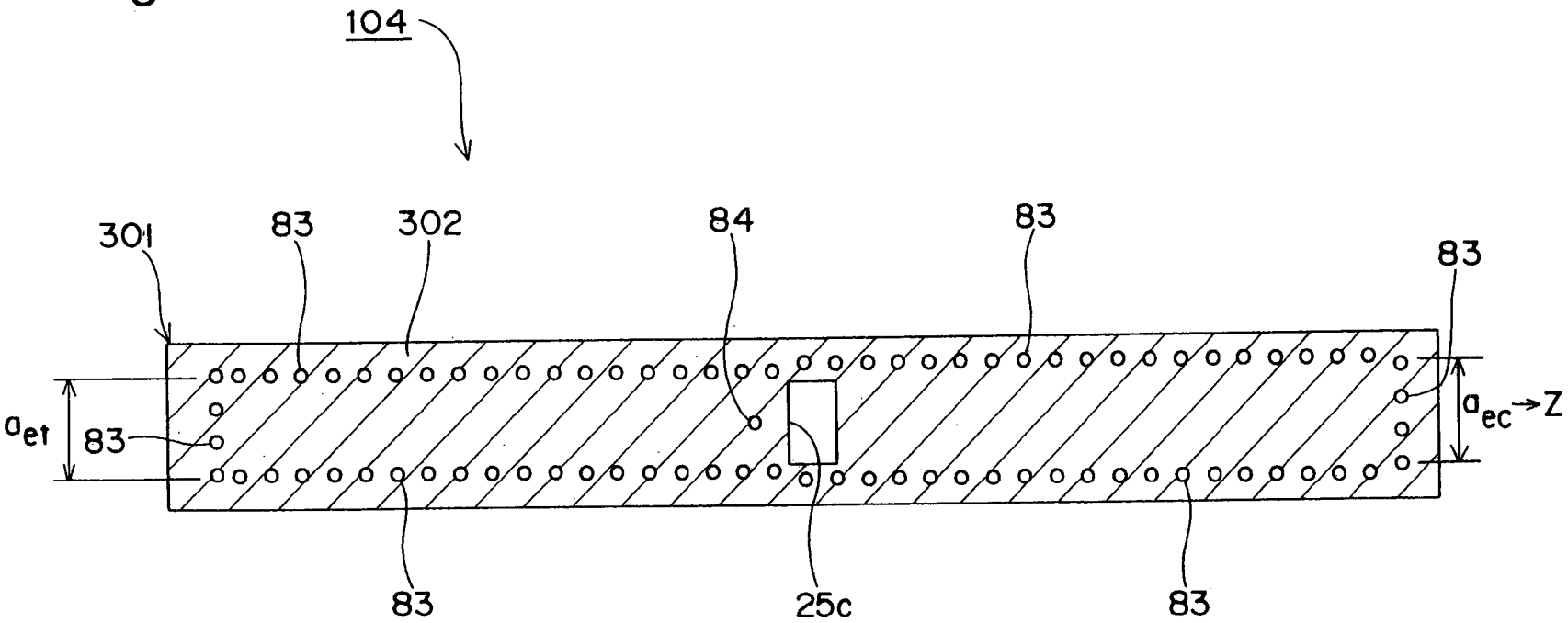
FIG. 15 is a bottom view of the traveling-wave combining array antenna apparatus 104 of FIG. 13.
Figure 16:
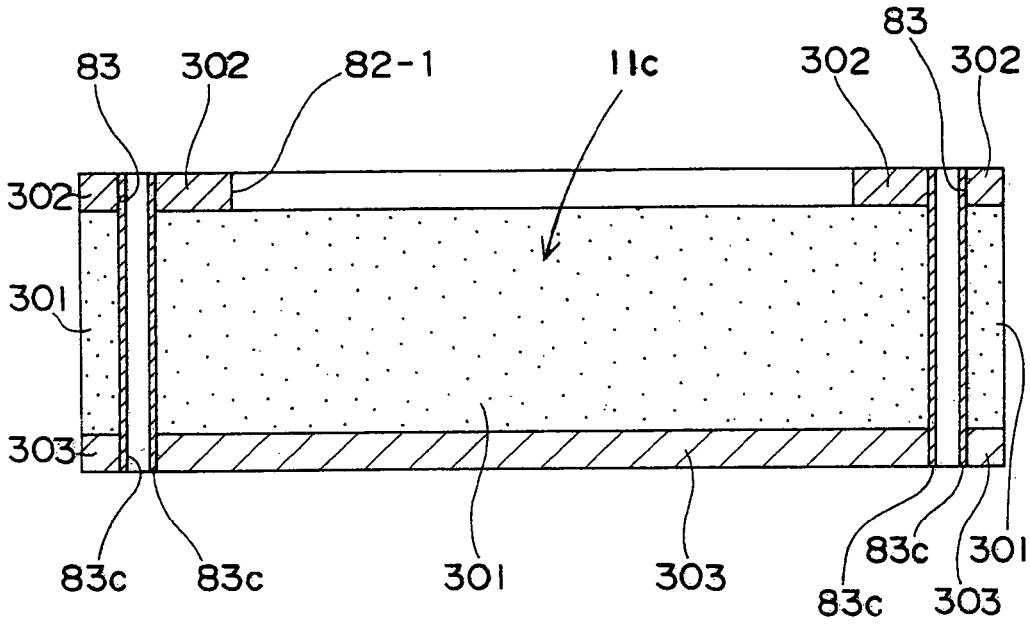
FIG. 16 is a longitudinal sectional view taken along the B–B' plane of FIG. 14.

FIG. 13 is a perspective view showing a constitution of a traveling-wave combining array antenna apparatus 104 of a fourth preferred embodiment according to the present invention, FIG. 14 is a top view of the traveling-wave combining array antenna apparatus 104 of FIG. 13, FIG. 15 is a bottom view of the traveling-wave combining array antenna apparatus 104 of FIG. 13, and FIG. 16 is a longitudinal sectional view taken along the B–B' plane of FIG. 14.

The traveling-wave combining array antenna apparatus 104 according to this fourth preferred embodiment is characterized in that traveling-wave array antennas 1*c* and 2*c*, each of which is a known post-wall dielectric waveguide slot array antennas formed on a dielectric substrate 301, are provided in juxtaposition so that their traveling directions of electromagnetic waves traveling in a feeder line within the dielectric substrate 301 become opposite to each other ($\phi_m$=180 degrees).

Referring to FIG. 16, on the dielectric substrate 301, an upper-surface conductor 302 is formed on its top surface while a lower-surface conductor 303 is formed on its bottom surface. In the close vicinity of both side surfaces and in the close vicinity of longitudinal end portions of the dielectric substrate 301, a plurality of through holes 83 having an inner diameter of "s" are formed at a predetermined interval of "t" so as to extend through the thickness direction of the dielectric substrate 301, and thereafter, through-hole conductors 83*c* are formed on their inner circumferential surfaces, so that at positions where the through holes 83 are formed, the upper-surface conductor 302 and the lower-surface conductor 303 are electrically connected to each other by the through-hole conductors 83*c*, and then, and then, a so-called "post wall" is formed. Also, as shown in FIGS. 14 and 15, a post-wall width on the traveling-wave array antenna 1*c* side is set to "$a_{e\ t}$", and a post-wall width on the traveling-wave array antenna 2*c* side and at central portion is set to "$a_{e\ c}$" (>$a_{e\ t}$). By the upper-surface conductor 302, the lower-surface conductor 303 and the post wall constituted as described above, a pseudo rectangular waveguide for confining and propagating an electromagnetic wave can be formed, and the resulting pseudo rectangular waveguide is referred to a "post-wall dielectric waveguide" 11*c*.

Furthermore, eight rectangular slots are formed in the upper-surface conductor 302 on the traveling-wave array antenna 1*c* side of the dielectric substrate 301 at a predetermined antenna element interval $d_1$ along the −Z-axis direction by, for example, etching process, and this leads to formation of a slot array antenna having eight slot antennas 81-1 to 81-8 constituting the traveling-wave array antenna 1*c*. On the other hand, eight rectangular slots are formed in the upper-surface conductor 302 on the traveling-wave array antenna 2*c* side of the dielectric substrate 301 at a predetermined antenna element interval d2 along the +Z-axis direction by, for example, etching process, and this leads to formation of a slot array antenna having eight slot antennas 82-1 to 82-8 constituting the traveling-wave array antenna 2*c*. It is noted that each of the rectangular slots is so formed that its longitudinal direction is parallel to a direction vertical to the Z-axis.

The spacing between the two traveling-wave array antennas 1*c* and 2*c*, i.e., the spacing between their first slot antennas 81-1 and 82-1 is set to a predetermined spacing distance $d_m$. Also, as shown in FIG. 15, a rectangular-shaped input opening 25*c* for connecting the power-feeding rectangular waveguide is formed in the lower-surface conductor 303 at the longitudinally central portion of the dielectric substrate 301. Further, at a position which is generally intermediate between the input opening 25*c* and the first slot antenna 81-1 and which is a widthwise central portion of the dielectric substrate 301, one through hole 84 having an inner diameter of "s" is formed so as to extend through the thickness direction of the dielectric substrate 301, and thereafter, a through-hole conductor (not shown) is formed on its inner circumferential surface, so that at the position where the through hole 84 is formed, the upper-surface conductor 302 and the lower-surface conductor 303 are electrically connected to each other by the through-hole conductor, and this leads to formation of a "post wall". This post wall constitutes an attenuator portion (corresponding to the attenuator portion 23*b* in the third preferred embodiment) for attenuating by a predetermined quantity of attenuation an electromagnetic wave that is inputted via the input opening 25*c* and thereafter inputted to the traveling-wave array antenna 1*c*.

As described above, the post-wall width on the traveling-wave array antenna 1*c* side is set to "at", the post-wall width on the traveling-wave array antenna 2*c* side and at central portion is set to "$a_{e\ c}$" and a post wall implemented by the through hole 84 provided between the input opening 25*c* and the first slot antenna 81-1 is formed, and this leads to formation of an attenuator portion.

In the traveling-wave combining array antenna apparatus 104 constituted as described above, an electromagnetic wave of a transmitting signal inputted from the power-feeding rectangular waveguide (not shown) via the input opening 25*c* is split into two waves in the post-wall dielectric waveguide 11*c* located just above the input opening 25*c*. One electromagnetic wave out of the two split waves travels in the post-wall dielectric waveguide 11*c* within the traveling-wave array antenna 2*c* along the Z-axis direction, and is radiated via the slot antennas 82-1 to 82-8. The other electromagnetic wave is subjected to a predetermined attenuation by the attenuator portion implemented by the through hole 84, and thereafter, travels in the post-wall dielectric waveguide 11*c* within the traveling-wave array antenna 1*c* along the −Z-axis direction, and is radiated via the slot antennas 81-1 to 81-8.

In the traveling-wave combining array antenna apparatus 104 according to the present preferred embodiment, the guide wavelength of the post-wall dielectric waveguide 11*c* can be changed by changing the dielectric constant and thickness of the dielectric substrate 301, the inner diameter "s" and distance "t" of the through holes 83 and 84 and the post wall width $a_{e\ t}$ and $a_{e\ c}$, thus making it possible to design the array antenna apparatus 104 on the assumption that this post-wall dielectric waveguide 11*c* is equivalent to a metal-wall dielectric rectangular waveguide having the same guide wavelength. Besides, since the traveling-wave combining array antenna apparatus 104 is constituted by using the dielectric substrate 301, the array antenna apparatus can be manufactured in a thin type with a lower cost.

Further, a desired vertical-plane radiating directivity characteristic can be obtained, by changing the respective lengths or widths of the rectangular slots of the respective slot antennas 81-1 to 81-8 and 82-1 to 82-8 so as to control the excitation amplitudes for the respective slot antennas 81-1 to 81-8 and 82-1 to 82-8, and by changing the antenna element distances $d_1$ and $d_2$ so as to control the excitation phases. In the present preferred embodiment, one traveling-wave array antenna 1*c* is formed so as to have a predetermined vertical-plane radiating directivity characteristic of a narrow beam and a low side lobe in a manner similar to that of the first preferred embodiment, while the other traveling-wave array antenna 2*c* is formed so as to have a predetermined vertical-plane radiating directivity characteristic of a cosecant-squared curve in a manner similar to that of the first preferred embodiment.

These traveling-wave array antennas 1*c* and 2*c* using the post-wall dielectric waveguide 11*c* are also traveling-wave array antennas, and in these travelling-wave array antennas 1*c* and 2*c*, the main-beam direction of the vertical-plane radiating directivity characteristic changes due to the predetermined frequency change Δf. However, since the post-wall dielectric waveguide 11*c* is branched into two directions at the input opening 25*c*, the traveling directions of electromagnetic waves traveling in the two traveling-wave array antennas 1*c* and 2*c* are opposite to each other, so that the variations Δθ of the main beams act in opposite directions to cancel each other. Thus, the variation Δθ of the main-beam direction can be suppressed in the whole traveling-wave combining array antenna apparatus 104.

Also, since the vertical-plane radiating directivity characteristic of one traveling-wave array antenna 2*c* is the predetermined directivity characteristic of the narrow beam and the low side lobe, the vertical-plane radiating directivity characteristic of the traveling-wave combining array antenna apparatus 104 can be maintained as the vertical-plane radiating directivity characteristic of the cosecant-squared curve.

Since the attenuator portion made by the through hole 84 is provided in the post-wall dielectric waveguide 11*c* on the traveling-wave array antenna 1*c* side as shown in FIGS. 13 to 15, the power fed to the traveling-wave array antenna 1*c* can be reduced, so that the vertical-plane radiating directivity characteristic even closer to the vertical-plane radiating directivity characteristic of the cosecant-squared curve can be obtained as the vertical-plane radiating directivity characteristic of the whole traveling-wave combining array antenna apparatus 104.

Also, the post-wall width $a_{e\ t}$ of the traveling-wave array antenna 1*c* is set so as to be smaller than the post-wall width $a_{e\ c}$ of the traveling-wave array antenna 2*c*. Setting one smaller post-wall width is equivalent to setting a smaller waveguide width of a metal-wall dielectric waveguide on the assumption that a post-wall dielectric waveguide is equivalent to a metal-wall dielectric waveguide. Therefore, in a manner similar to that of the case of the third preferred embodiment, the vertical-plane radiating directivity characteristic even closer to the vertical-plane radiating directivity characteristic of the cosecant-squared curve can be obtained, while the variation Δθ of the main-beam direction can be suppressed.

Although the post-wall widths of the two traveling-wave array antennas 1*c* and 2*c* are set so as to be different from each other in the above-mentioned preferred embodiment, the waveguide width can be equivalently changed also by changing the inner diameter "s" or distance "t" of the through holes 83, and similar effects can be obtained. Generally speaking, the guide wavelength can be increased by increasing the inner diameter "s" of the through holes 83, and the guide wavelength can be decreased by increasing the distance "t".

For example, in the case where the inner diameter "s" of the through holes 83 of the traveling-wave array antenna 1*c* is made correspondingly smaller than that of the traveling-wave array antenna 2*c*, the guide wavelength of the post-wall dielectric waveguide 11*c* of the traveling-wave array antenna 1*c* can be made smaller than the guide wavelength of the post-wall dielectric waveguide 11*c* of the traveling-wave array antenna 2*c*, so that the quantity of propagation attenuation in the traveling-wave array antenna 1*c* during propagation of an electromagnetic wave having a predetermined wavelength can be made larger than the quantity of propagation attenuation in the traveling-wave array antenna 2*c* while the above-mentioned quantity of phase delay in the traveling-wave array antenna 1*c* can be made larger than the quantity of phase delay in the traveling-wave array antenna 2*c*.

Further, in the case where the distance "t" of the through holes 83 of the traveling-wave array antenna 1*c* is increased so as to be correspondingly larger than that of the traveling-wave array antenna 2*c*, the guide wavelength of the post-wall dielectric waveguide 11*c* of the traveling-wave array antenna 1*c* can be made smaller than the guide wavelength of the post-wall dielectric waveguide 11*c* of the traveling-wave array antenna 2*c*, so that the quantity of propagation attenuation in the traveling-wave array antenna 1*c* during propagation of an electromagnetic wave having a predetermined wavelength can be made larger than the quantity of propagation attenuation in the traveling-wave array antenna 2*c* while the above-mentioned quantity of phase delay in the traveling-wave array antenna 1*c* can be made larger than the quantity of phase delay in the traveling-wave array antenna 2*c*.

FIFTH PREFERRED EMBODIMENT

Figure 17:
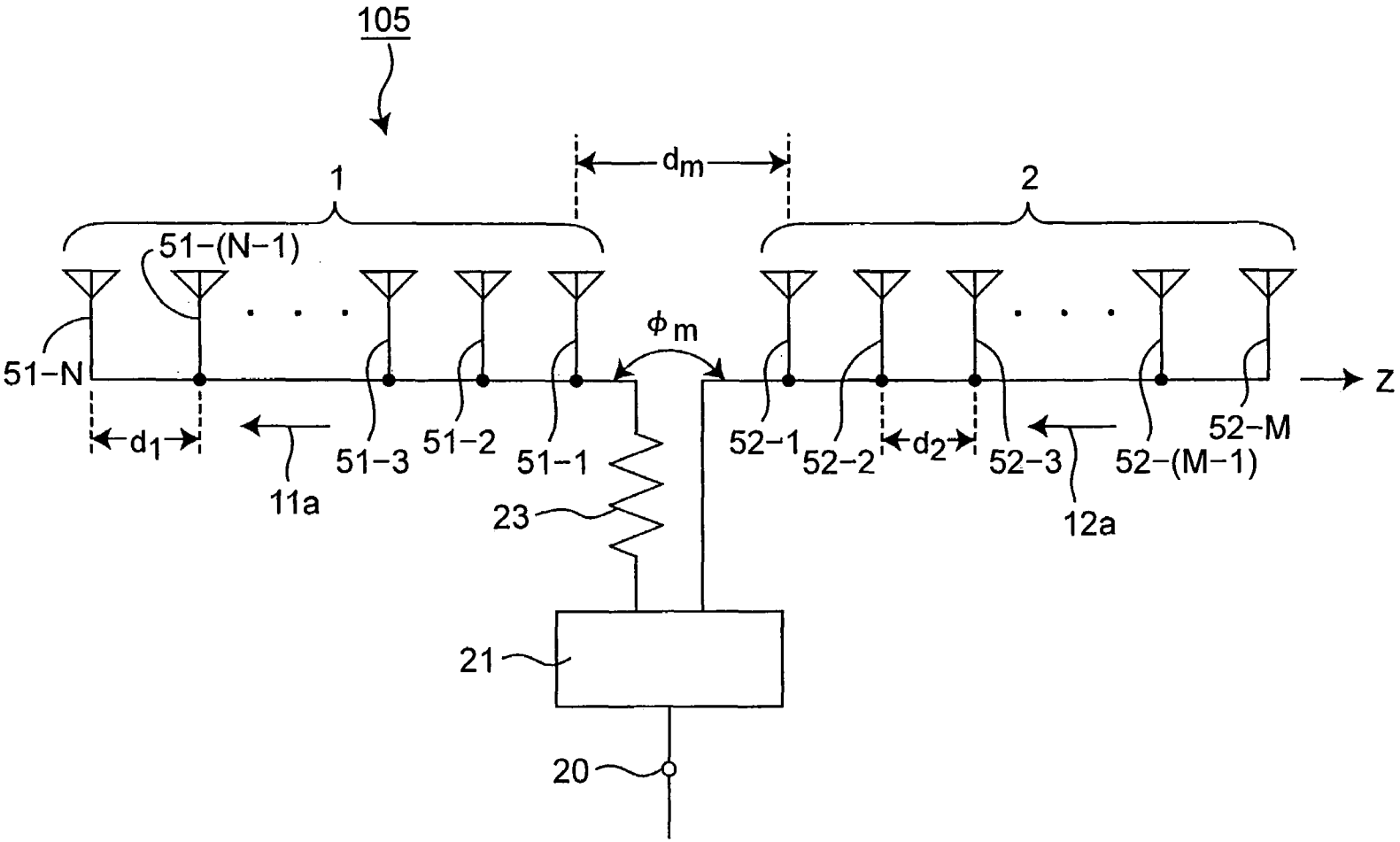
FIG. 17 is a perspective view showing a constitution of a traveling-wave combining array antenna apparatus 105 of a fifth preferred embodiment according to the present invention.

FIG. 17 is a perspective view showing a constitution of a traveling-wave combining array antenna apparatus 105 of a fifth preferred embodiment according to the present invention. The traveling-wave combining array antenna apparatus according to the fifth preferred embodiment is characterized in that the traveling-wave combining array antenna apparatus 105 has the following differences as compared with the first preferred embodiment shown in FIG. 1. The other constitution is similar to that of the first preferred embodiment. That is, the power of the transmitting signal inputted via the feeding point is split into two signals with an equal splitting ratio by the power splitter 21. Thereafter, one split transmitting signal is inputted to the traveling-wave array antenna 1 via the attenuator 23, while the other split transmitting signal is inputted to the traveling-wave array antenna 2 as it is.

In the traveling-wave combining array antenna apparatus 105 according to the fifth preferred embodiment constituted as described above, the traveling-wave array antenna 1 is formed so as to have a directivity of a narrower beam and a lower side lobe than those of the traveling-wave array antenna 2, while the traveling-wave array antenna 2 is formed so as to have a directivity of a cosecant-squared curve. The power of the transmitting signal fed to the traveling-wave array antenna 1 is attenuated by the attenuator 23 as compared to the traveling-wave array antenna 2, and this leads to a construction of an array antenna in which the variation in the main-beam direction due to frequency change is suppressed.

SIXTH PREFERRED EMBODIMENT

Figure 18:
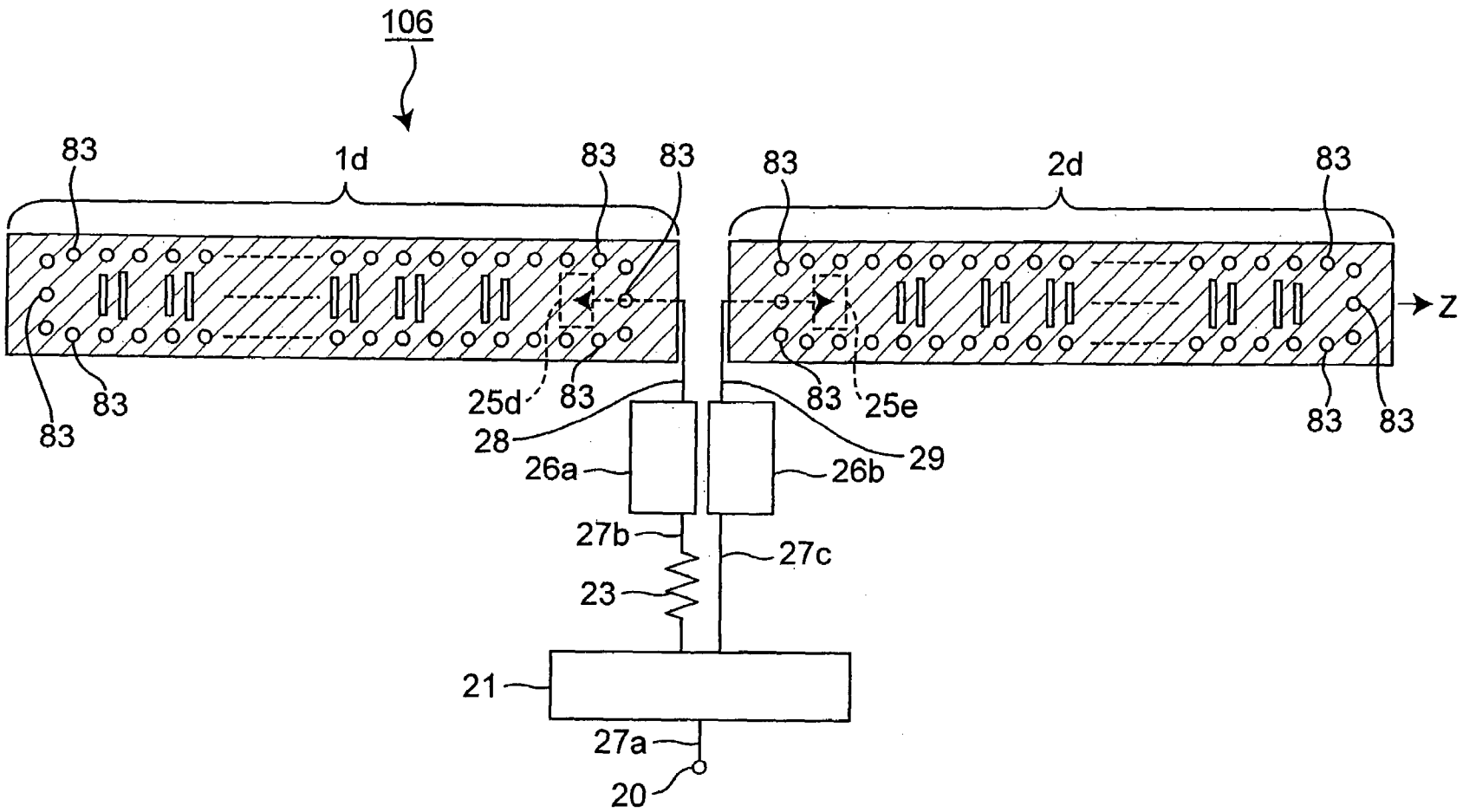
FIG. 18 is a perspective view showing a constitution of a traveling-wave combining array antenna apparatus 106 of a sixth preferred embodiment according to the present invention.

FIG. 18 is a perspective view showing a constitution of a traveling-wave combining array antenna apparatus 106 of a sixth preferred embodiment according to the present invention. The traveling-wave combining array antenna apparatus 106 according to the sixth preferred embodiment is characterized in that:

(a) the traveling-wave array antenna 1 of the fifth preferred embodiment is formed so that each antenna element has two slots (of the second preferred embodiment) and that a post-wall dielectric waveguide (of the fourth preferred embodiment) is used; and (b) the traveling-wave array antenna 2 of the fifth preferred embodiment is so formed that each antenna element has two slots (of the second preferred embodiment) and that a post-wall dielectric waveguide (of the fourth preferred embodiment) is used.

Referring to FIG. 18, the power of the transmitting signal inputted via a feeding point and a coaxial cable 27*a* is split into two signals with an equal splitting ratio by the power splitter 21. Then one split transmitting signal is inputted to a coaxial to waveguide converter 26*a* via the attenuator 23 and a coaxial cable 27*b*, while the other split transmitting signal is inputted to a coaxial to waveguide converter 26*b* via a coaxial cable 27*c* as it is. After the coaxial to waveguide converter 26*a* converts the inputted transmitting signal into a transmitting signal that propagates in the waveguide, the transmitting signal is inputted into the waveguide of a traveling-wave array antenna 1*d* via a connecting waveguide 28 and an input opening 25*d* of the waveguide of the traveling-wave array antenna 1*d*. Then the transmitting signal propagates along the waveguide, and is radiated from the antenna elements. On the other hand, after the coaxial to waveguide converter 26*b* converts the inputted transmitting signal into a transmitting signal that propagates in the waveguide, the transmitting signal is inputted into the waveguide of a traveling-wave array antenna 2*d* via a connecting waveguide 29 and an input opening 25*e* of the waveguide of the traveling-wave array antenna 1*d*. Then the transmitting signal propagates along the waveguide, and is radiated from the antenna elements.

In the present preferred embodiment, in a manner similar to that of the fifth preferred embodiment, the traveling-wave array antenna 1*d* is formed so as to have a directivity of a narrower beam and a lower side lobe than those of the traveling-wave array antenna 2, while the traveling-wave array antenna 2*d* is formed so as to have a directivity of a cosecant-squared curve.

Referring to FIG. 18, when the transmission path length of the two connecting waveguides 28 and 29 are equal to each other, then phases at the input openings 25*d* and 25*e* of the waveguides of the traveling-wave array antennas 1*d* and 2*d* are made so as to be the same as each other by adjusting the difference between the lengths of the two coaxial cables 27*b* and 27*c*. Further, the quantities of powers of the transmitting signals fed to the two traveling-wave array antennas 1 and 2 are controlled by adjusting the quantity of attenuation by the attenuator 23.

The results of the simulation on the traveling-wave combining array antenna apparatus 106 constituted as described above are described below with reference to FIGS. 19A, 19B, 19C, 20A, 20B, 20C, 21A, 21B and 21C.

Figure 19A:
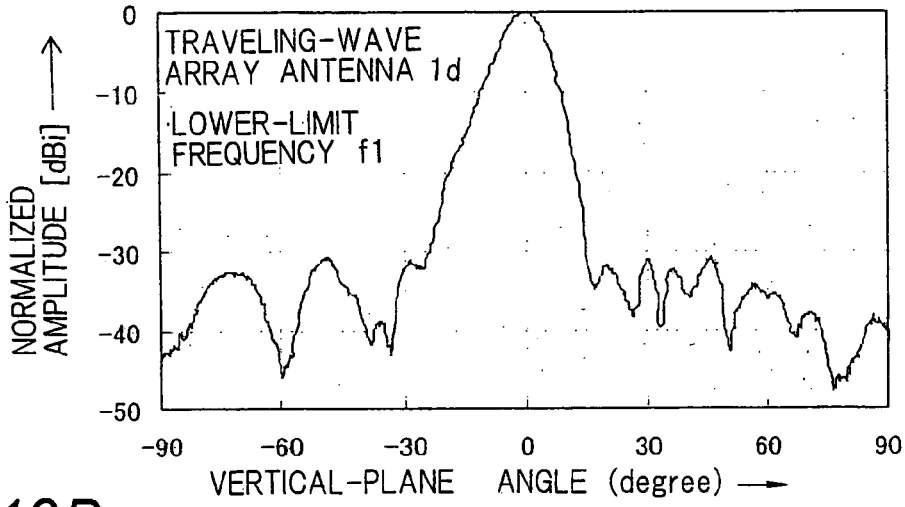
FIG. 19A is a graph showing a radiating pattern (normalized amplitude) versus a vertical-plane angle of a traveling-wave array antenna 1*d* of FIG. 18 with a lower-limit frequency of f1.
Figure 19B:
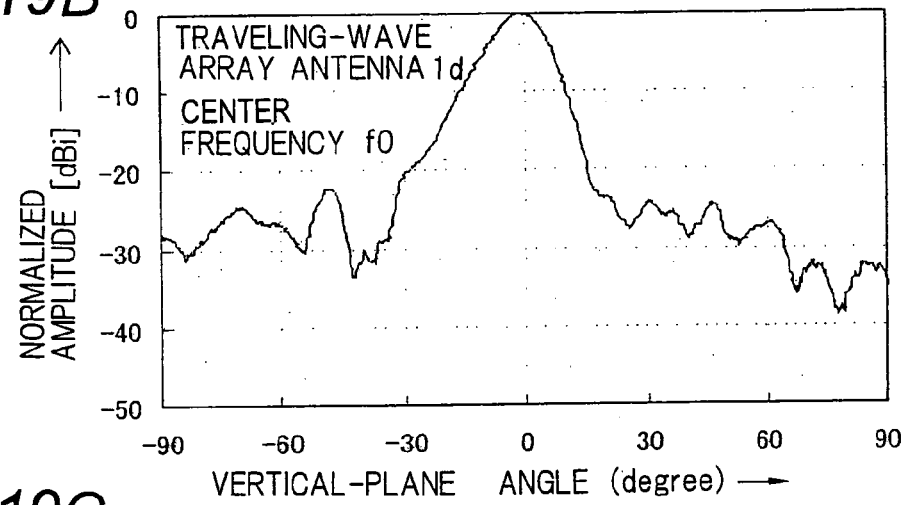
FIG. 19B is a graph showing a radiating pattern (normalized amplitude) versus a vertical-plane angle of the traveling-wave array antenna 1*d* of FIG. 18 with a center frequency of f0.
Figure 19C:
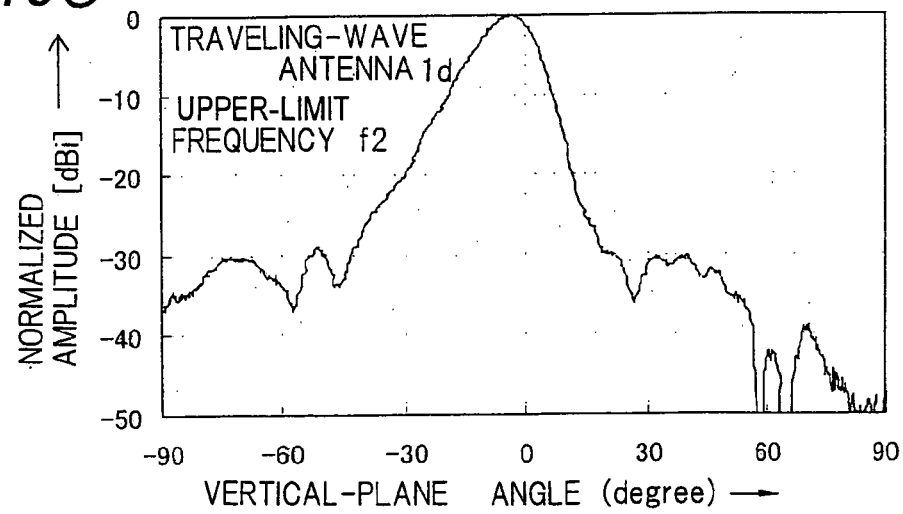
FIG. 19C is a graph showing a radiating pattern (normalized amplitude) versus a vertical-plane angle of the traveling-wave array antenna 1*d* of FIG. 18 with an upper-limit frequency of f2.
Figure 20A:
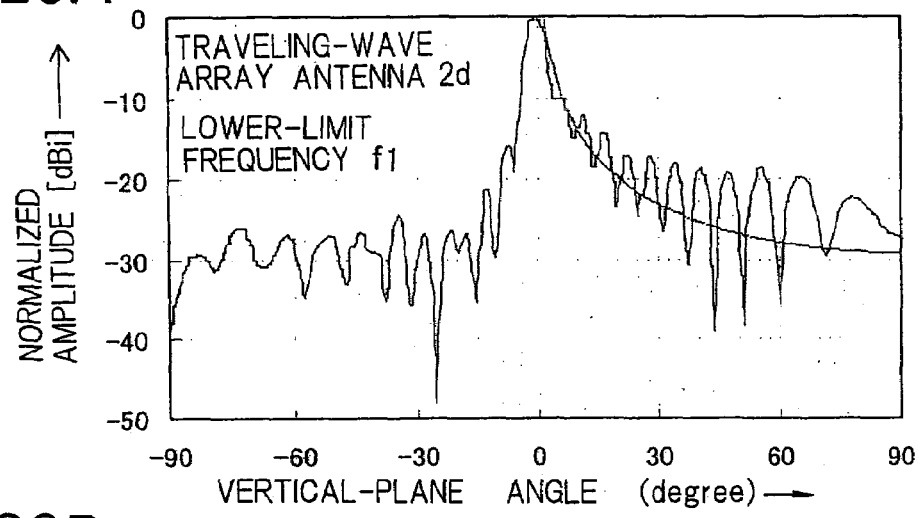
FIG. 20A is a graph showing a radiating pattern (normalized amplitude) versus a vertical-plane angle of a traveling-wave array antenna 2*d* of FIG. 18 with a lower-limit frequency of f1.
Figure 20B:
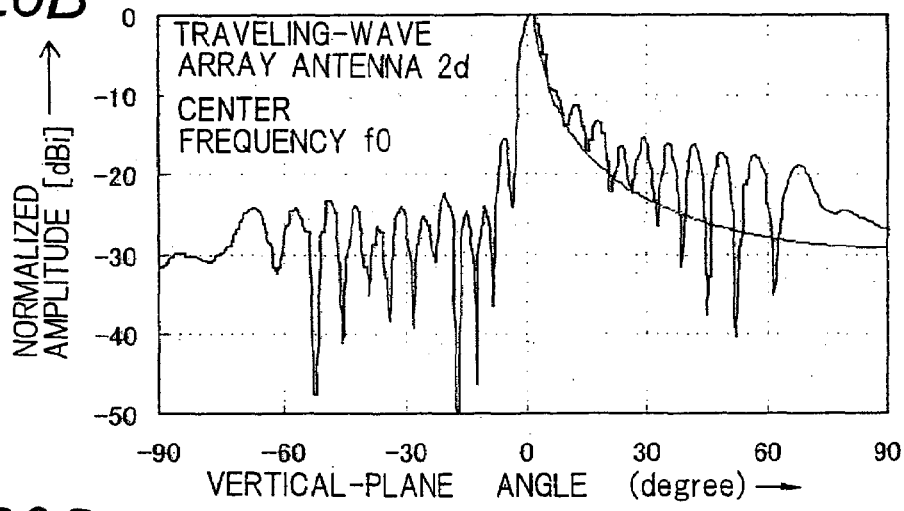
FIG. 20B is a graph showing a radiating pattern (normalized amplitude) versus a vertical-plane angle of the traveling-wave array antenna 2*d* of FIG. 18 with a center frequency of f0.
Figure 20C:
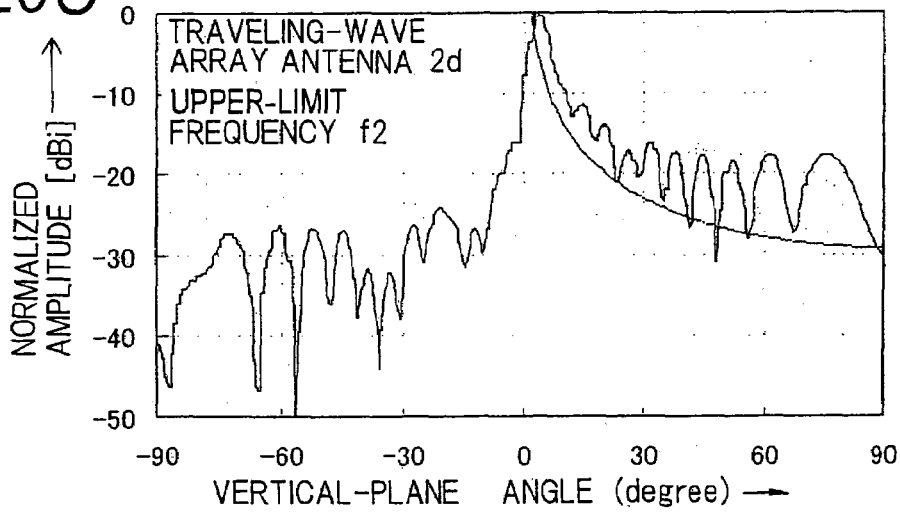
FIG. 20C is a graph showing a radiating pattern (normalized amplitude) versus a vertical-plane angle of the traveling-wave array antenna 2*d* of FIG. 18 with an upper-limit frequency of f2.
Figure 21A:
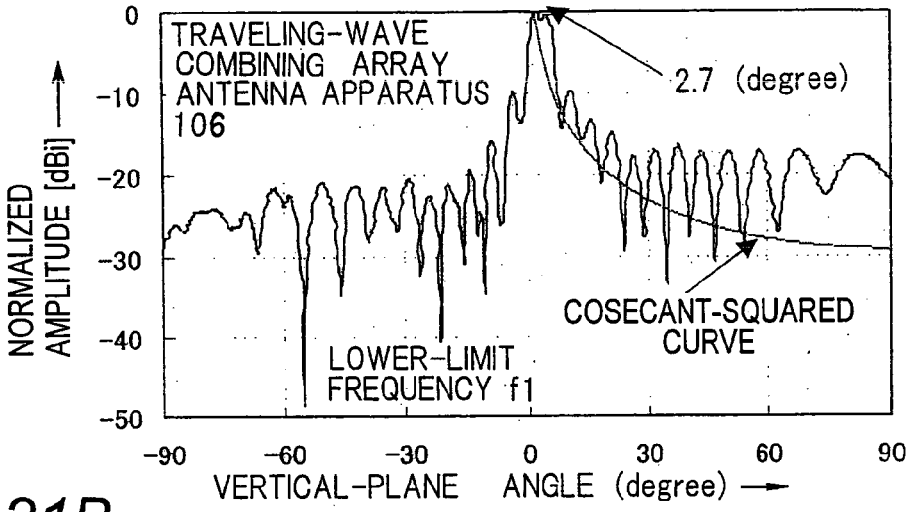
FIG. 21A is a graph showing a radiating pattern (normalized amplitude) versus a vertical-plane angle of the traveling-wave combining array antenna apparatus 106 of FIG. 18 with a lower-limit frequency of f1.

FIG. 19A is a graph showing a radiating pattern (normalized amplitude) versus a vertical-plane angle of the traveling-wave array antenna 1*d* of FIG. 18 with a lower-limit frequency of f1, FIG. 19B is a graph showing a radiating pattern (normalized amplitude) versus a vertical-plane angle of the traveling-wave array antenna 1*d* of FIG. 18 with a center frequency of f0, and FIG. 19C is a graph showing a radiating pattern (normalized amplitude) versus a vertical-plane angle of the traveling-wave array antenna 1*d* of FIG. 18 with an upper-limit frequency of f2. FIG. 20A is a graph showing a radiating pattern (normalized amplitude) versus a vertical-plane angle of a traveling-wave array antenna 2*d* of FIG. 18 with a lower-limit frequency of f1, FIG. 20B is a graph showing a radiating pattern (normalized amplitude) versus a vertical-plane angle of the traveling-wave array antenna 2*d* of FIG. 18 with a center frequency of f0, and FIG. 20C is a graph showing a radiating pattern (normalized amplitude) versus a vertical-plane angle of the traveling-wave array antenna 2*d* of FIG. 18 with an upper-limit frequency of f2. FIG. 21A is a graph showing a radiating pattern (normalized amplitude) versus a vertical-plane angle of the traveling-wave combining array antenna apparatus 106 of FIG. 18 with a lower-limit frequency of f1, FIG. 21B is a graph showing a radiating pattern (normalized amplitude) versus a vertical-plane angle of the traveling-wave combining array antenna apparatus 106 of FIG. 18 with a center frequency of f0, and FIG. 21C is a graph showing a radiating pattern (normalized amplitude) versus a vertical-plane angle of the traveling-wave combining array antenna apparatus 106 of FIG. 18 with an upper-limit frequency of f2.

As apparent from FIGS. 19A, 19B and 19C, the half-value width (which is referred to as a half-value width of the main beam at −3 dB of amplitude normalized by the maximum value of the antenna gain thereof) of the main beam of the traveling-wave array antenna 1*d* includes the maximum value of the main beam, and the traveling-wave array antenna 1*d* has a tailor directivity having a narrow beam of 30° or smaller and a low side lobe of −20 dB or lower (than those of the traveling-wave array antenna 2*d*). On the other hand, the traveling-wave array antenna 2*d* has a cosecant-squared directivity characteristic along a cosecant-squared curve. In the present preferred embodiment, when the frequency of the traveling-wave array antenna 1 is changed from the lower-limit frequency f1=25.27 GHz to the upper-limit frequency f2=25.69 GHz, the resulting variation $\Delta\theta$ of the main-beam direction is 7.9 degrees, approximately a double of the variation $\Delta\theta c$=3.8 degrees of the traveling-wave array antenna 2.

Figure 21B:
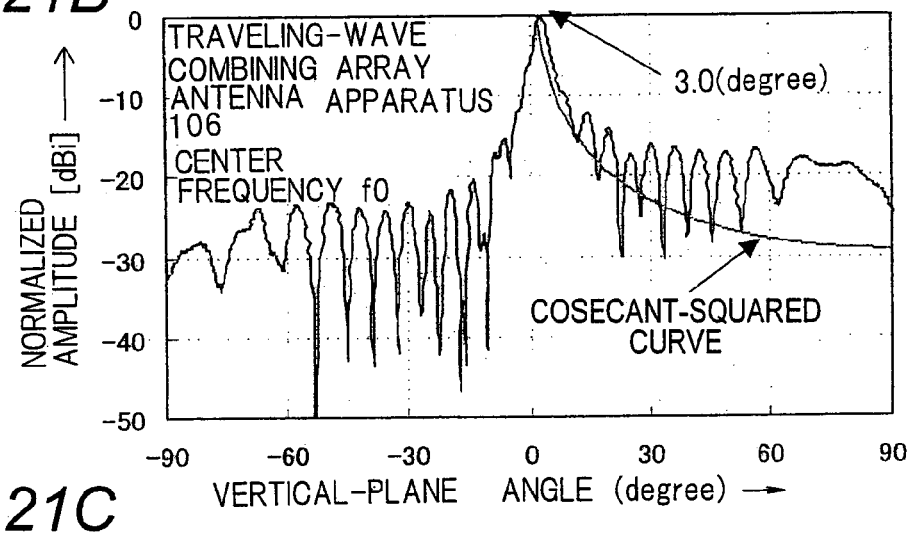
FIG. 21B is a graph showing a radiating pattern (normalized amplitude) versus a vertical-plane angle of the traveling-wave combining array antenna apparatus 106 of FIG. 18 with a center frequency of f0.
Figure 21C:
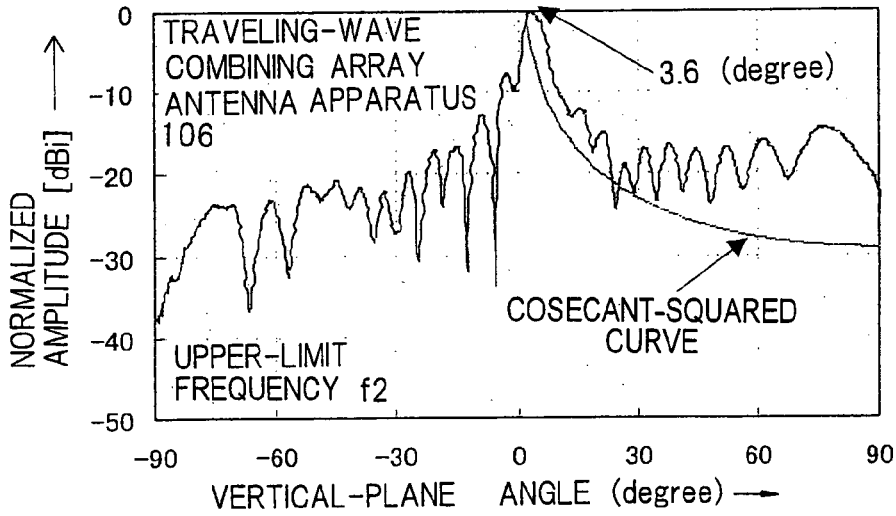
FIG. 21C is a graph showing a radiating pattern (normalized amplitude) versus a vertical-plane angle of the traveling-wave combining array antenna apparatus 106 of FIG. 18 with an upper-limit frequency of f2.

FIGS. 21A, 21B and 21C show measuring results of radiating directivity in a case where the phases of the traveling-wave array antennas 1*d* and 2*d* at the input openings 25*d* and 25*e* (feeding point) were made identical to each other by setting the quantity of attenuation of the attenuator 23 to 16 dB and by adjusting the difference between the lengths of the coaxial cables 27*b*.

As apparent from FIGS. 21A, 21B and 21C, it has been attained by using the traveling-wave array antenna apparatus 106 according to the present preferred embodiment to suppress the variation $\Delta\theta$ of the main-beam direction to 0.9 degrees, as compared with the directivity characteristic of the traveling-wave array antenna 2*d* alone having the cosecant-squared directivity characteristic. Also, although the traveling-wave array antenna 1*d* having the directivity characteristic of the relatively narrow beam and the low side lobe was used, yet the results showed that the cosecant-squared directivity characteristic was not disturbed by virtue of the suppression of the input power of the transmitting signal inputted to the traveling-wave array antenna 1*d* by using the attenuator 23.

Consequently, by the traveling-wave combining array antenna apparatus 106 according to the present preferred embodiment, an array antenna apparatus having the cosecant-squared directivity characteristic with the variation $\Delta\theta$ of the main-beam direction suppressed can be realized.

MODIFICATION EXAMPLES OF SIXTH PREFERRED EMBODIMENT

Figure 22:
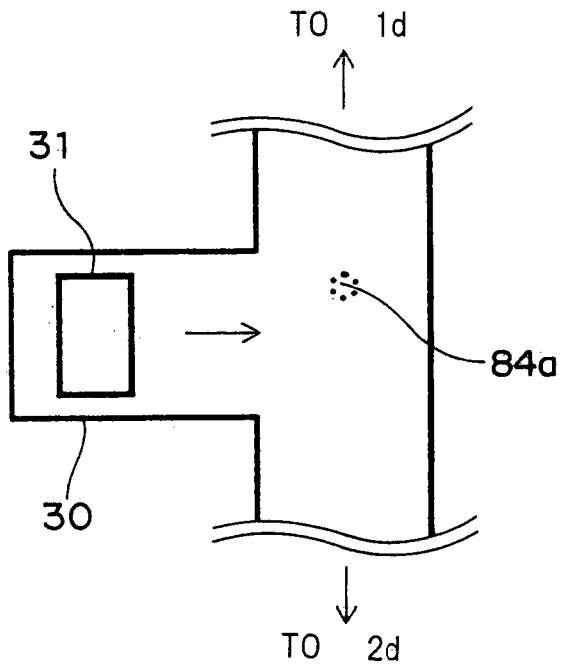
FIG. 22 is a cross-sectional view showing a constitution of a power splitter section of a first modification example of the sixth preferred embodiment.

FIG. 22 is a cross-sectional view showing a constitution of a power splitter section of a first modification example of the sixth preferred embodiment.

Figure 23:
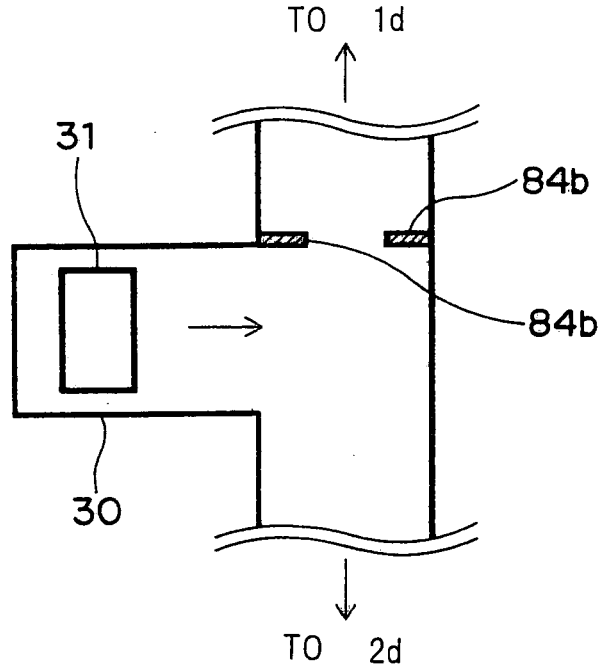
FIG. 23 is a cross-sectional view showing a constitution of a power splitter section of a second modification example of the sixth preferred embodiment.

Referring to FIG. 22, the waveguide of the traveling-wave array antenna 1*d* and the waveguide of the traveling-wave array antenna 2*d* shown in FIG. 18 are connected to each other at a central portion of FIG. 18, where these waveguides face each other in a manner similar to that of in the fourth preferred embodiment of FIG. 13 (in FIGS. 22 to 23, a wall forming the waveguide is indicated not by the through-hole conductors 83*c* but by solid line; in addition, the waveguides may be also normal waveguides similar to those of the first to third preferred embodiments). A branching waveguide 30 is formed at the central portion so as to project and extend in a direction perpendicular to the longitudinal direction of the waveguide, and an input opening 31 connected to the feeding point 20 is formed so as to be close to the terminating end of the branching waveguide 30. Further, in the close vicinity of an input end of the central portion on the traveling-wave array antenna 1*d* side, a plurality of conductor pins 84*a* are provided so as to be parallel to the thickness direction of the waveguides. In the power splitter section constituted as described above, a transmitting signal inputted via the input opening 31 propagates along the branching waveguide 30, is split at the central portion into two directions perpendicular to the branching waveguide 30, and then, the split transmitting signals are inputted to the traveling-wave array antennas 1*d* and 2*d*, respectively. In the close vicinity of the input end of the traveling-wave array antenna 1*d*, because of formation of a plurality of conductor pins 84*a*, the transmitting signal propagating there is subjected to an attenuation of an attenuation quantity determined depending on the number of the plurality of conductor pins 84*a*, and then, is inputted to the traveling-wave array antenna 1*d*. Therefore, this first modification example has a constitution similar to that of the power splitter 21 and the attenuator 23 shown in FIG. 18. Although a plurality of conductor pins 84*a* are provided in the above-mentioned first modification example, it is also possible to use, for example, at least one conductor pin having a larger diameter instead of this.

FIG. 23 is a cross-sectional view showing a constitution of a power splitter section of a second modification example of the sixth preferred embodiment.

Referring to FIG. 23, the second modification example is characterized in that a waveguide wall 84*b* for narrowing the lateral width of the relevant waveguide is formed at an input end of the traveling-wave array antenna 1*d* instead of the plurality of conductor pins 84*a* of FIG. 22. In the power splitter section constituted as described above, a transmitting signal inputted via the input opening 31, propagates along the waveguide 30, is split at the central portion into two directions perpendicular to the branching waveguide 30, and then the split transmitting signals are inputted to the traveling-wave array antennas 1*d* and 2*d*, respectively. In the close vicinity of the input end of the traveling-wave array antenna 1*d*, because of formation of the waveguide wall 84*b*, the transmitting signal propagating there is subjected to an attenuation of an attenuation quantity determined depending on the width of the waveguide wall 84*b*, and then, is inputted to the traveling-wave array antenna 1*d*. Therefore, this second modification example has a constitution similar to that of the power splitter 21 and the attenuator 23 shown in FIG. 18.

Figure 24:
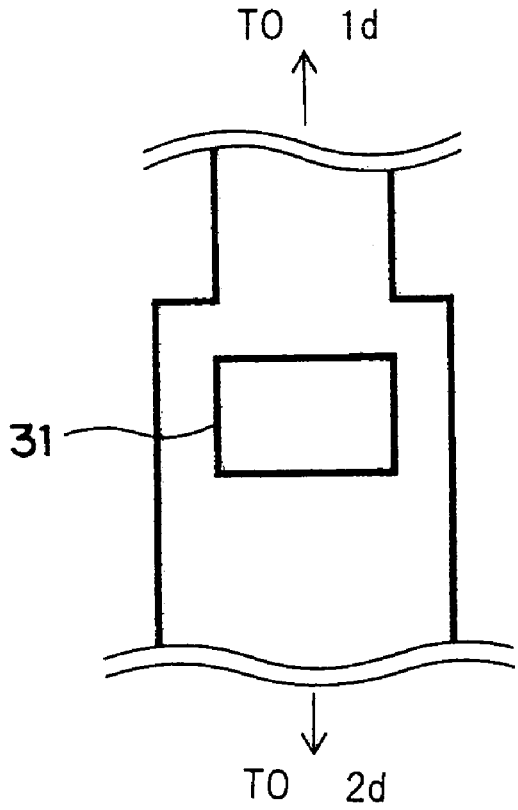
FIG. 24 is a cross-sectional view showing a constitution of a power splitter section of a third modification example of the sixth preferred embodiment.

FIG. 24 is a cross-sectional view showing a constitution of a power splitter section of a third modification example of the sixth preferred embodiment.

Referring to FIG. 24, the waveguide of the traveling-wave array antenna 1*d* and the waveguide of the traveling-wave array antenna 2*d* shown in FIG. 18 are connected to each other at a central portion of FIG. 18 where those waveguides face each other in a manner similar to that of the fourth preferred embodiment of FIG. 13, and moreover, the widths of the waveguides of the two traveling-wave array antennas 1*d* and 2*d* are made different from each other in a manner similar to that of the third preferred embodiment. In this case, the width of the waveguide of the traveling-wave array antenna 1*d* is narrower than the width of the waveguide of the traveling-wave array antenna 2*d*. Also, an input opening 31 connected to the feeding point is formed at the central portion. With the constitution as described above, the transmitting signal propagating in the traveling-wave array antenna 1*d* is subjected to an attenuation of a predetermined attenuation quantity, as compared to the transmitting signal propagating in the traveling-wave array antenna 2*d*, thus producing working effects similar to those of the foregoing first and second modification examples.

IMPLEMENTAL EXAMPLES

The present inventors manufactured a prototype of a traveling-wave array antenna apparatus according to the sixth preferred embodiment and performed an experiment on its electrical characteristics. The results of the experiment are described below. Whereas the simulation results (numerical analysis results) of the traveling-wave array antenna apparatus according to the sixth preferred embodiment have been described above, their validity is verified through this experiment.

Given that the excitation amplitude for the traveling-wave array antenna 1*d* is At, the excitation amplitude for the traveling-wave array antenna 2*d* is Ac, the variation of the main-beam direction of the traveling-wave array antenna 1*d* is $\Delta\theta t$, and that the variation of the main-beam direction of the traveling-wave array antenna 2*d* is $\Delta\theta c$, then, an excitation amplitude ratio of Ac/At=12 dB and a variation ratio of $\Delta\theta t/\Delta\theta c=2.2$ of the main-beam direction were obtained as optimum values by numerical calculations in the simulation of the sixth preferred embodiment. Here are shown design conditions of the prototype apparatus in the following table.

TABLE 7

| Design Conditions of Traveling-Wave Array Antenna Apparatus 106 | Traveling-Wave Array Antenna 1d | Traveling-Wave Array Antenna 2d |
|---|---|---|
| Dielectric Constant $\epsilon_r$ | 6 | 2.2 |
| Thickness of Substrate [mm] | 1.6 | 3.2 |
| Radius of Through Hole [mm] | 0.6 | 0.6 |
| Pitch of Through Hole [mm] | 2.4 | 2.4 |
| Width of Post-Wall waveguide [mm] | 5.56 | 7.93 |
| Slot Pair No. | 16 | 16 |
| Array Length [mm] | 110 | 160 |

In this case, as an experimental approach, the excitation amplitude ratio Ac/At is obtained by splitting the fed power by the power splitter 21 and the attenuator 23 as shown in FIG. 18. The power splitter 21 used in this case is HP-87304C type hybrid divider made by Hewlett Packard. This power splitter 21 is capable of obtaining two output signals of equal amplitude and identical phase for one input signal. Then, the excitation amplitude for the traveling-wave array antenna 1*d* is lowered by the attenuator 23, and this leads to that the excitation amplitude ratio Ac/At is obtained. In this case, an attenuation x (dB) of the attenuator 23 is expressed by the following Equation (1):

$$x = 10\log\frac{\sum_n \{A_c(n)\}^2}{\sum_n \{A_t(n)\}^2} + 20\log\frac{A_c}{A_t}, \quad (1)$$

where At(n) represents an excitation amplitude of the n-th antenna element of the traveling-wave array antenna 1*d*, and Ac(n) represents an excitation amplitude of the n-th antenna element of the traveling-wave array antenna 2*d*. Also, the variation ratio Δθt/Δθc of the main-beam direction is given by a difference in dielectric constant between the dielectric substrates constituting the waveguides, respectively, as described above. In addition, the apparatus constitution for the experiment is the same as that shown in FIG. 18. In FIG. 18, as described above, the difference between line lengths of the two coaxial cables 27*b* and 27*c* was adjusted so that the phase difference between transmitting signals at respective input end portions of the traveling-wave array antennas 1*d* and 2*d* would be substantially zero.

Next, structural parameters of the traveling-wave array antennas 1*d* and 2*d* are shown in the following tables.

TABLE 8

Structural Parameters of Traveling-Wave Array Antenna 1d

| Element No. | Element Position | Slot length L1 | Slot length L2 | Slot Interval $d_1$ |
|---|---|---|---|---|
| 1 | 4.814 | 1.726 | 1.735 | 0.662 |
| 2 | 10.243 | 1.808 | 1.821 | 0.668 |
| 3 | 15.614 | 2.093 | 2.114 | 0.641 |
| 4 | 20.851 | 2.401 | 2.433 | 0.592 |
| 5 | 25.933 | 2.573 | 2.612 | 0.550 |
| 6 | 30.808 | 2.741 | 2.784 | 0.482 |
| 7 | 35.475 | 2.829 | 2.872 | 0.432 |
| 8 | 39.932 | 2.939 | 2.980 | 0.356 |
| 9 | 44.136 | 2.993 | 3.031 | 0.314 |
| 10 | 48.129 | 3.075 | 3.107 | 0.244 |
| 11 | 52.045 | 3.049 | 3.083 | 0.267 |
| 12 | 55.957 | 3.023 | 3.059 | 0.289 |
| 13 | 60.029 | 2.893 | 2.935 | 0.390 |
| 14 | 64.620 | 2.687 | 2.729 | 0.507 |
| 15 | 69.551 | 2.418 | 2.451 | 0.589 |
| 16 | 74.684 | 2.242 | 2.268 | 0.619 |

Note:
Input opening position is 0; slot width is 0.4; unit is (mm) for all.

TABLE 9

Structural Parameters of Traveling-Wave Array Antenna 2d

| Element No. | Element Position | Slot length L1 | Slot length L2 | Slot Interval $d_1$ |
|---|---|---|---|---|
| 1 | 4.814 | 3.736 | 3.811 | 0.959 |
| 2 | 14.335 | 3.74 | 3.815 | 0.958 |
| 3 | 23.187 | 3.798 | 3.875 | 0.928 |
| 4 | 31.86 | 3.8 | 3.877 | 0.927 |
| 5 | 40.568 | 3.767 | 3.843 | 0.944 |
| 6 | 49.307 | 3.79 | 3.867 | 0.932 |
| 7 | 57.911 | 3.83 | 3.907 | 0.911 |
| 8 | 66.495 | 3.826 | 3.903 | 0.913 |
| 9 | 75.167 | 3.798 | 3.875 | 0.928 |
| 10 | 83.759 | 3.825 | 3.902 | 0.913 |

TABLE 9-continued

Structural Parameters of Traveling-Wave Array Antenna 2d

| Element No. | Element Position | Slot length L1 | Slot length L2 | Slot Interval $d_1$ |
|---|---|---|---|---|
| 11 | 92.262 | 3.84 | 3.918 | 0.904 |
| 12 | 100.907 | 3.784 | 3.86 | 0.936 |
| 13 | 109.597 | 3.744 | 3.819 | 0.956 |
| 14 | 118.086 | 3.758 | 3.834 | 0.949 |
| 15 | 126.66 | 3.719 | 3.793 | 0.968 |
| 16 | 134.077 | 4.087 | 4.164 | 0.728 |

Notes:
Input opening position is 0; slot width is 0.4; unit is (mm) for all.

Figure 25:
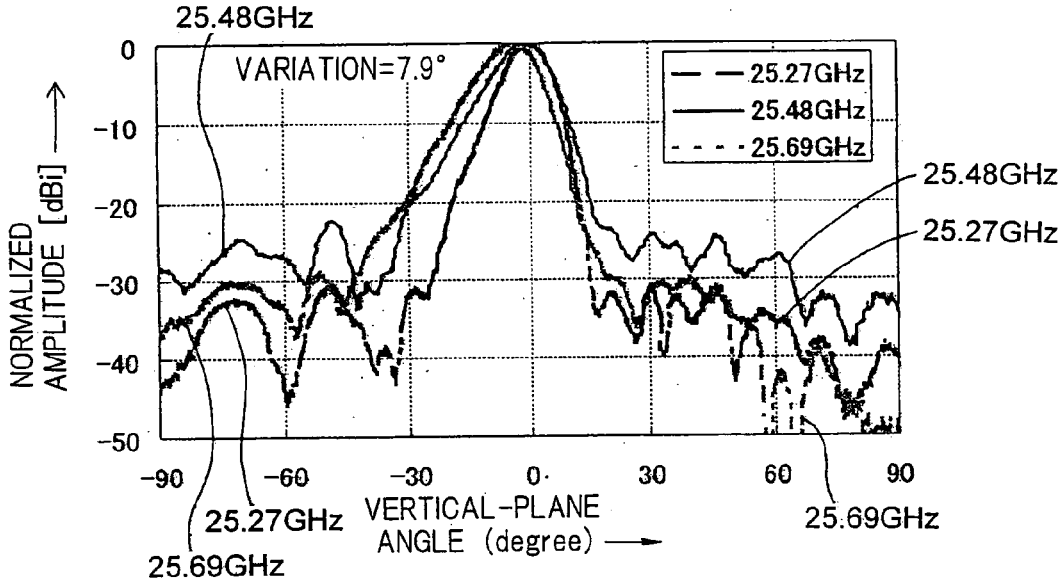
FIG. 25 is a graph showing measured values (experimental values) of directivity characteristics of the traveling-wave array antenna 1*d* of the traveling-wave array antenna apparatus according to the sixth preferred embodiment.
Figure 26:
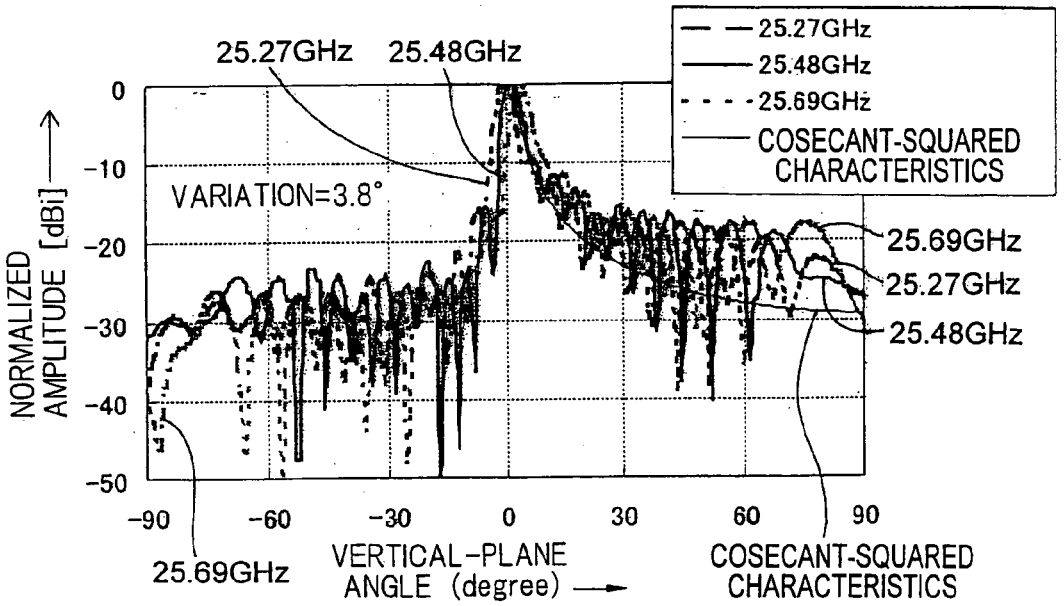
FIG. 26 is a graph showing measured values (experimental values) of directivity characteristics of the traveling-wave array antenna 2*d* of the traveling-wave array antenna apparatus according to the sixth preferred embodiment.
Figure 27:
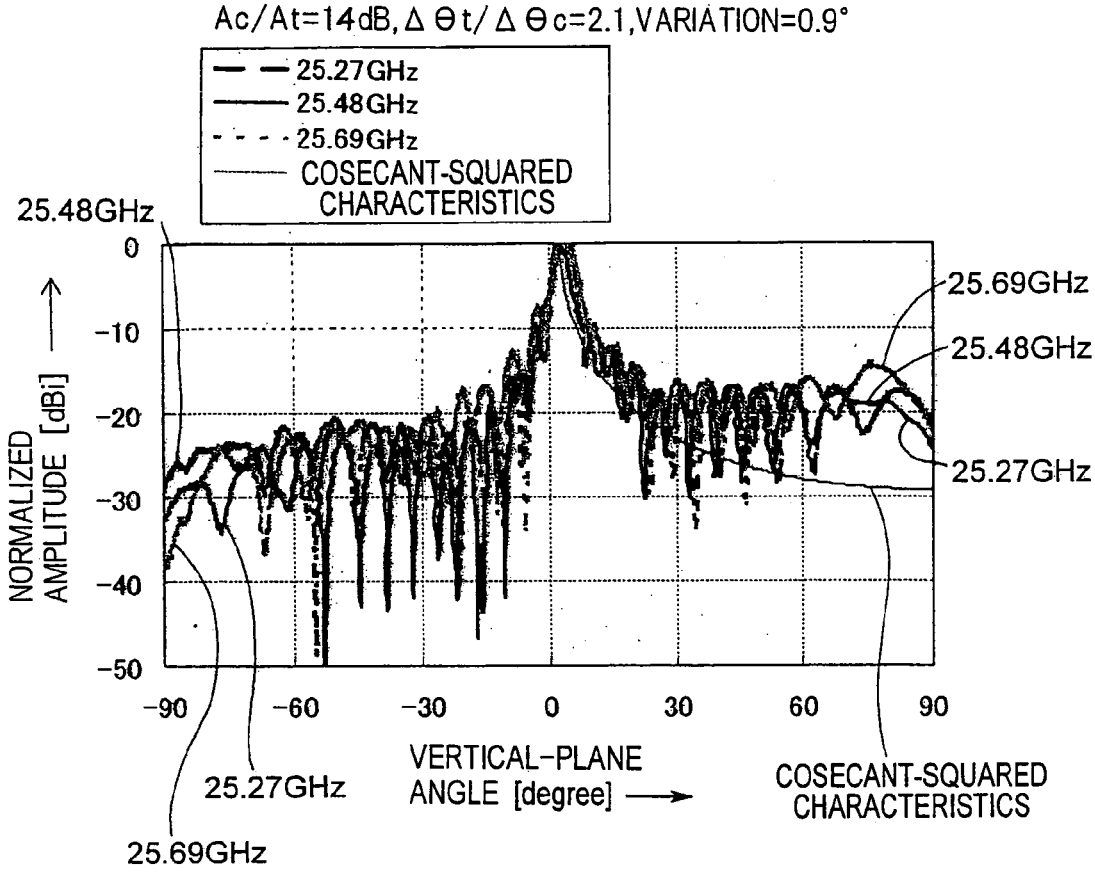
FIG. 27 is a graph showing measured values (experimental values) of directivity characteristics of the traveling-wave array antenna apparatus according to the sixth preferred embodiment.

FIG. 25 is a graph showing measured values (experimental values) of the directivity characteristic of the traveling-wave array antenna 1*d* of the traveling-wave array antenna apparatus according to the preferred embodiment, FIG. 26 is a graph showing measured values (experimental values) of directivity characteristics of the traveling-wave array antenna 2*d* of the traveling-wave array antenna apparatus according to the sixth preferred embodiment, and FIG. 27 is a graph showing measured values (experimental values) of directivity-characteristics of the traveling-wave array antenna apparatus according to the sixth preferred embodiment.

As apparent from FIG. 25, the variation of the main-beam direction relative to the frequency of the traveling-wave array antenna 1*d* was Δθt=7.9°. Also, in FIG. 26, the variation of the main-beam direction of the traveling-wave array antenna 2*d* in its cosecant-squared directivity characteristic was Δθc=3.8°. Accordingly, the resultant variation ratio of the main-beam direction is Δθt/Δθc=2.1. Under these conditions, a relationship between the excitation amplitude ratio Ac/At and the variation Δθ of the main-beam direction in the traveling-wave array antenna 2*d* relative to the frequency of the whole traveling-wave array antenna apparatus is charted in FIG. 27. It can be understood that these results of FIG. 27 exhibit behavior similar to the foregoing simulation results. Then, it can be also understood that a variation Δθ=0.9 degree of the main-beam direction can be obtained with an excitation amplitude ratio of Ac/At=14 dB.

Figure 28:
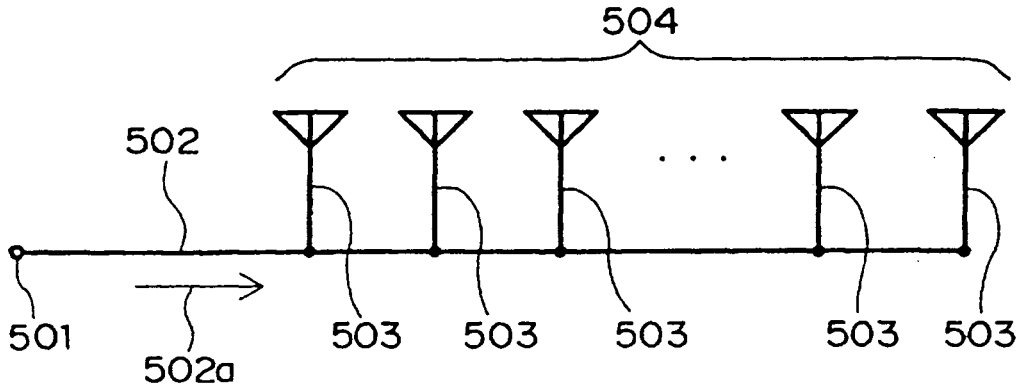
Fig.28 PRIOR ART
FIG. 28 is a circuit diagram showing a constitution of a traveling-wave array antenna apparatus 504 according to the prior art.
Figure 29:
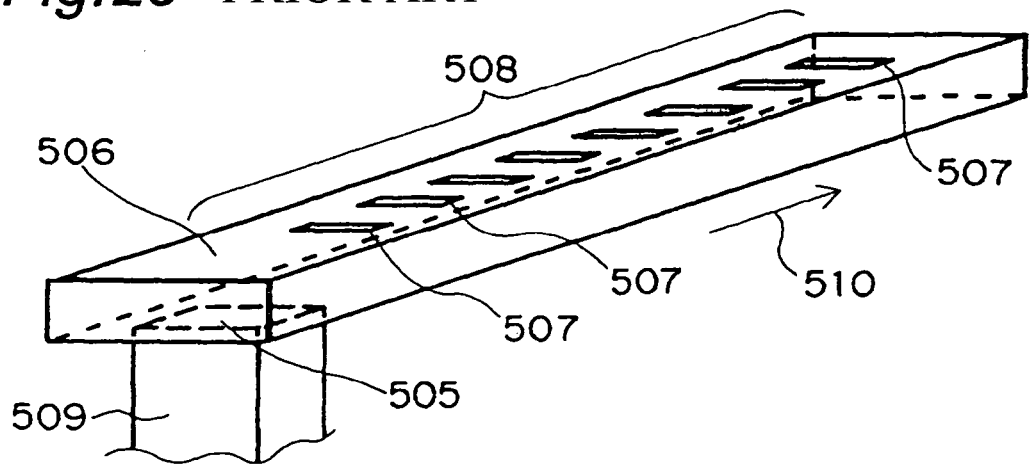
Fig.29 PRIOR ART
FIG. 29 is a perspective view showing a constitution of a waveguide slot array antenna apparatus 508 of an example of the traveling-wave array antenna apparatus of FIG. 28.

Under these conditions, the directivity characteristics of the whole traveling-wave array antenna apparatus are shown in FIG. 28.

Referring to FIG. 28, the variances of the cosecant-squared characteristic at a lower-limit frequency of $f_L$=25.27 GHz, a desired frequency of $f_D$=25.48 GHz and an upper-limit frequency of $f_H$=25.69 GHz are σ($f_L$)=71%, σ($f_D$)=71% and σ($f_L$)=73%, respectively, and this makes it understood that the cosecant-squared directivity characteristic were able to be maintained for the 26 GHz FWA frequency band. Also, whereas the frequency variation of the antenna gain was 3.34 dB in the case of the traveling-wave array antenna 2*d* alone having the cosecant-squared directivity characteristic, the frequency variation of the traveling-wave array antenna apparatus according to the sixth preferred embodiment was 1.3 dB, hence a smaller frequency variation.

OTHER MODIFICATION EXAMPLES

The above-mentioned preferred embodiments have been described on a method for suppressing the change in the main beam in the vertical-plane radiating directivity characteristic. However, the present invention is not limited to this, and it is also possible to adopt a method for suppressing the change in the main beam in the horizontal-plane directivity characteristic in a similar manner.

In the above-mentioned preferred embodiments, the other traveling-wave array antennas 2, 2*a*, 2*b*, 2*c* and 2*d* are formed so as to have the radiating directivity characteristic of the cosecant-squared curve. However, the present invention is not limited to this, and those traveling-wave array antennas may be also formed, for example, so as to have a radiating directivity characteristic of a narrow beam and a low side lobe similar to those of the first preferred embodiment or a predetermined beam characteristic.

INDUSTRIAL APPLICABILITY

As described in detail hereinabove, according to the present invention, there is provided a traveling-wave combining array antenna apparatus includes first and second traveling-wave array antennas, and a splitter device. The first traveling-wave array antenna has a plurality of first antenna elements provided at predetermined intervals along a first feeder line, and has a predetermined radiating directivity characteristic. The second traveling-wave array antenna has a plurality of second antenna elements provided at predetermined intervals along a second feeder line, and has a main beam of a predetermined half-value width and a radiating directivity characteristic of a side lobe level lower than that of the first traveling-wave array antenna. The splitter device splits an inputted transmitting signal into two transmitting signals, feeding one split transmitting signal to the first traveling-wave array antenna, and feeding another split transmitting signal to the second traveling-wave array antenna.

The first and second traveling-wave array antennas are provided in such a manner that a crossing angle between a traveling direction of an electromagnetic wave of the transmitting signal traveling along the first feeder line and a traveling direction of an electromagnetic wave of the transmitting signal traveling along the second feeder line is larger than 90 degrees and smaller than 270 degrees, so that a variation of main-beam radiating angle of an electromagnetic wave of a transmitting signal radiated from the first traveling-wave array antenna corresponding to a predetermined frequency change, and a variation of main-beam radiating angle of an electromagnetic wave of a transmitting signal radiated from the second traveling-wave array antenna corresponding to the frequency change, are substantially canceled by each other.

In the above-mentioned traveling-wave combining array antenna apparatus, the radiating directivity characteristic of the second traveling-wave array antenna preferably includes (a) a main beam having a half-value width equal to or smaller than 30 degrees, the main beam including a maximum value of an antenna gain, and (b) a side lobe level smaller than −20 dB of the maximum value of the antenna gain.

In the above-mentioned traveling-wave combining array antenna apparatus, the first traveling-wave array antenna and the second traveling-wave array antenna are preferably provided in such a manner that the traveling direction of the electromagnetic wave of the transmitting signal traveling along the first feeder line and the traveling direction of the electromagnetic wave of the transmitting signal traveling along the second feeder line become substantially opposite to each other.

In the above-mentioned traveling-wave combining array antenna apparatus, the first traveling-wave array antenna preferably has a radiating directivity characteristic of a predetermined cosecant-squared curve.

Therefore, according to the present invention, the variation of the main-beam radiating angle of the electromagnetic wave of the transmitting signal radiated from the first traveling-wave array antenna corresponding to the frequency change, and the variation of the main-beam radiating angle of the electromagnetic wave of the transmitting signal radiated from the second traveling-wave array antenna corresponding to the frequency change, are substantially canceled by each other. Thus, it becomes implementable to direct the main beam to a desired destination station with a desired design angle.

In the above-mentioned traveling-wave combining array antenna apparatus, the splitter device preferably includes a power controller which splits a power of the inputted transmitting signal so that a power of the transmitting signal fed to the first traveling-wave array antenna and a power of the transmitting signal fed to the second traveling-wave array antenna become different from each other. Further, in the above-mentioned traveling-wave combining array antenna apparatus, the power controller preferably includes an attenuator device which attenuates the transmitting signal fed to the second traveling-wave array antenna by a predetermined attenuation quantity. As a result of this, the radiating directivity characteristic of the second traveling-wave array antenna can be made predominant over the radiating directivity characteristic of the first traveling-wave array antenna, so that the radiating directivity characteristic of the whole traveling-wave combining array antenna apparatus can be made similar to that of the second traveling-wave array antenna.

Furthermore, the above-mentioned traveling-wave combining array antenna apparatus preferably further includes a phase-delay quantity setting device which sets a quantity of phase delay of the second traveling-wave array antenna so as to be larger than a quantity of phase delay of the first traveling-wave array antenna. The cancellation quantity of variations of the main-beam directions of the first and second traveling-wave array antennas becomes adjustable, so that the variations of the main-beam directions can be suppressed while the desired radiating directivity characteristic are maintained.

The invention claimed is:

1. A traveling-wave combining array antenna apparatus comprising:

a first traveling-wave array antenna having a plurality of first antenna elements provided at predetermined intervals along a first feeder line, said first traveling-wave array antenna having a predetermined radiating directivity characteristic;

a second traveling-wave array antenna having a plurality of second antenna elements provided at predetermined intervals along a second feeder line, said second traveling-wave array antenna having a main beam of a predetermined half-value width and a radiating directivity characteristic of a side lobe level lower than the predetermined radiating directivity characteristic of said first traveling-wave array antenna; and splitting means for splitting an inputted transmitting signal into first and second split transmitting signals, feeding the first split transmitting signal to said first traveling-wave array antenna, and feeding the second split transmitting signal to said second traveling-wave array antenna, wherein said first traveling-wave array antenna and said second traveling-wave array antenna are provided in such a manner that a crossing angle between a traveling direction of an electromagnetic wave of the first split transmitting signal traveling along said first feeder line and a traveling direction of an electromagnetic wave of the second split transmitting signal traveling along said second feeder line is larger than 90 degrees and smaller than 270 degrees, so that a variation of a main-beam radiating angle of the electromagnetic wave of the first transmitting signal radiated from said first traveling-wave array antenna corresponding to a predetermined frequency change, and a variation of a main-beam radiating angle of the electromagnetic wave of the second transmitting signal radiated from said second traveling-wave array antenna corresponding to the frequency change, are substantially canceled by each other.

2. The traveling-wave combining array antenna apparatus as claimed in claim 1, wherein the half-value width of the main beam of said second traveling-wave array antenna is equal to or smaller than 30 degrees, the main beam of said second traveling-wave array antenna including a maximum value of an antenna gain, and wherein the side lobe level of the radiating directivity characteristic of said second traveling-wave array antenna is smaller than −20 dB of the maximum value of the antenna gain.

3. The traveling-wave combining array antenna apparatus as claimed in claim 1, wherein said first traveling-wave array antenna and said second traveling-wave array antenna are provided in such a manner that the traveling direction of the electromagnetic wave of the first split transmitting signal traveling along said first feeder line and the traveling direction of the electromagnetic wave of the second split transmitting signal traveling along said second feeder line become substantially opposite to each other.

4. The traveling-wave combining array antenna apparatus as claimed in claim 1, wherein said first traveling-wave array antenna has the radiating directivity characteristic of a predetermined cosecant-squared curve.

5. The traveling-wave combining array antenna apparatus as claimed in claim 1, wherein said splitting means includes power control means for splitting a power of the inputted transmitting signal so that a power of the first split transmitting signal fed to said first traveling-wave array antenna and a power of the second split transmitting signal fed to said second traveling-wave array antenna are different from each other.

6. The traveling-wave combining array antenna apparatus as claimed in claim 5, wherein said power control means includes attenuation means for attenuating the second split transmitting signal fed to said second traveling-wave array antenna by a predetermined attenuation quantity.

7. The traveling-wave combining array antenna apparatus as claimed in claim 6, wherein each of said first and second traveling-wave array antennas is one of a waveguide slot array antenna, a dielectric waveguide slot array antenna and a post-wall dielectric waveguide slot array antenna, and wherein said attenuation means is formed by setting a waveguide width of a waveguide of said second traveling-wave array antenna so as to be smaller than a waveguide width of a waveguide of said first traveling-wave array antenna.

8. The traveling-wave combining array antenna apparatus as claimed in claim 6, wherein each of said first and second traveling-wave array antennas is one of a dielectric waveguide slot array antenna and post-wall dielectric waveguide slot array antenna, and wherein said attenuation means is formed by setting a dielectric constant of a dielectric waveguide of said second traveling-wave array antenna so as to be larger than a dielectric constant of a dielectric waveguide of said first traveling-wave array antenna.

9. The traveling-wave combining array antenna apparatus as claimed in claim 6, wherein each of said first and second travelling-wave array antennas is a post-wall dielectric waveguide slot array antenna, and wherein said attenuation means is formed by setting an inner diameter of each through hole of a post wall of said second traveling-wave array antenna so as to be smaller than an inner diameter of each through hole of a post wall of said first traveling-wave array antenna.

10. The traveling-wave combining array antenna apparatus as claimed in claim 6, wherein each of said first and second traveling-wave array antennas is a post-wall dielectric waveguide slot array antenna, and wherein said attenuation means is formed by setting an interval of through holes of a post wall of said second traveling-wave array antenna so as to be larger than an interval of through holes of a post wall of said first traveling-wave array antenna.

11. The traveling-wave combining array antenna apparatus as claimed in claim 6, wherein each of said first and second traveling-wave array antennas is one of a waveguide slot array antenna, a dielectric waveguide slot array antenna and a post-wall dielectric waveguide slot array antenna, and wherein said attenuation means includes at least one conductor pin formed so as to close to an input opening of a waveguide of said second traveling-wave array antenna.

12. The traveling-wave combining array antenna apparatus as claimed in claim 6, wherein each of said first and second traveling-wave array antennas is one of a waveguide slot array antenna, a dielectric waveguide slot array antenna and a post-wall dielectric waveguide slot array antenna, and wherein said attenuation means includes a waveguide wall formed so as to be close to an input opening of a waveguide of said second traveling-wave array antenna.

13. The traveling-wave combining array antenna apparatus as claimed in claim 1, wherein each of said first and second traveling-wave array antennas is one of a waveguide slot array antenna, a dielectric waveguide slot array antenna and a post-wall dielectric waveguide slot array antenna, and wherein said splitting means and said first and second traveling-wave array antennas are formed within an identical waveguide.

14. The traveling-wave combining array antenna apparatus as claimed in claim 1, further comprising phase-delay quantity setting means for setting a quantity of phase delay of said second traveling-wave array antenna so as to be larger than a quantity of phase delay of said first traveling-wave array antenna.

15. The traveling-wave combining array antenna apparatus as claimed in claim 14, wherein said phase-delay quantity setting means is formed by setting an interval of the second antenna elements of said second traveling-wave array antenna so as to be larger than an interval of the first antenna elements of said first traveling-wave array antenna.

* * * * *

UNITED STATES PATENT AND TRADEMARK OFFICE

CERTIFICATE OF CORRECTION

PATENT NO. : 7,091,921 B2
APPLICATION NO. : 10/504995
DATED : August 15, 2006
INVENTOR(S) : Takeshi Ohno et al.

It is certified that error appears in the above-identified patent and that said Letters Patent is hereby corrected as shown below:

On the Title Page

In Item (73) Assignee, please correct the Assignee to read as follows:

Matsushita Electric Industrial Co., Ltd., Osaka (JP)

Signed and Sealed this

Twenty-seventh Day of March, 2007

JON W. DUDAS
*Director of the United States Patent and Trademark Office*